US010993535B2

(12) United States Patent
Nill et al.

(10) Patent No.: US 10,993,535 B2
(45) Date of Patent: May 4, 2021

(54) PIVOT FITTING AND PIECE OF FURNITURE

(71) Applicant: HETTICH FRANKE GMBH & CO. KG, Balingen-Weilstetten (DE)

(72) Inventors: Oliver Nill, Hechingen (DE); Gerd Stauss, Winterlingen (DE); Steffen Grathwol, Balingen (DE)

(73) Assignee: HETTICH FRANKE GMBH & CO. KG, Balingen-Weilstetten (DE)

( * ) Notice: Subject to any disclaimer, the term of this patent is extended or adjusted under 35 U.S.C. 154(b) by 0 days.

(21) Appl. No.: 16/612,182

(22) PCT Filed: May 7, 2018

(86) PCT No.: PCT/EP2018/061683
§ 371 (c)(1),
(2) Date: Nov. 8, 2019

(87) PCT Pub. No.: WO2018/206487
PCT Pub. Date: Nov. 15, 2018

(65) Prior Publication Data

US 2021/0007487 A1 Jan. 14, 2021

(30) Foreign Application Priority Data

May 11, 2017 (DE) ..... 10 2017 110 246.9

(51) Int. Cl.
*A47C 7/54* (2006.01)
*A47C 1/03* (2006.01)
*A47C 7/38* (2006.01)

(52) U.S. Cl.
CPC ..... *A47C 1/0308* (2018.08); *A47C 7/38* (2013.01); *A47C 7/541* (2018.08)

(58) Field of Classification Search
CPC ..... A47C 1/0308; A47C 7/38; A47C 7/541
(Continued)

(56) References Cited

U.S. PATENT DOCUMENTS 3,737,946 A * 6/1973 Giuliani ..... F16C 11/10 16/325
4,082,352 A * 4/1978 Bales ..... B60N 2/2358 16/325
(Continued)

FOREIGN PATENT DOCUMENTS

DE 202005011386 U1 9/2005
DE 202006019497 U1 6/2007
(Continued)

OTHER PUBLICATIONS

International Search Report dated Jul. 4, 2018 in related/corresponding International Application No. PCT/EP2018/061683.
(Continued)

*Primary Examiner* — Rodney B White
(74) *Attorney, Agent, or Firm* — Patent Portfolio Builders PLLC

(57) ABSTRACT

A pivot fitting for movable furniture parts on pieces of furniture, has a first lever and a second lever that are mounted to pivot about a common axis from a basic position through a predetermined angle, a clamping mechanism with which the two levers are fixable relative to each other at different angular positions within the predetermined angle. The clamping mechanism includes a toothing attached in a rotationally fixed manner to the second lever, at least one catch pivotally mounted on the first lever and loaded in the direction of the toothing, the catch engaging with the toothing in a detent position, a control disc mounted to pivot about the common axis, with which control disc the at least one catch can be disengaged from the toothing when the predetermined angle has been passed in an adjusting direction from the basic position so that when the catch is disengaged from the toothing, the two levers can be pivoted back into the basic position when the predetermined angle is passed in a resetting direction. The control disc can be
(Continued)

Figure 1:
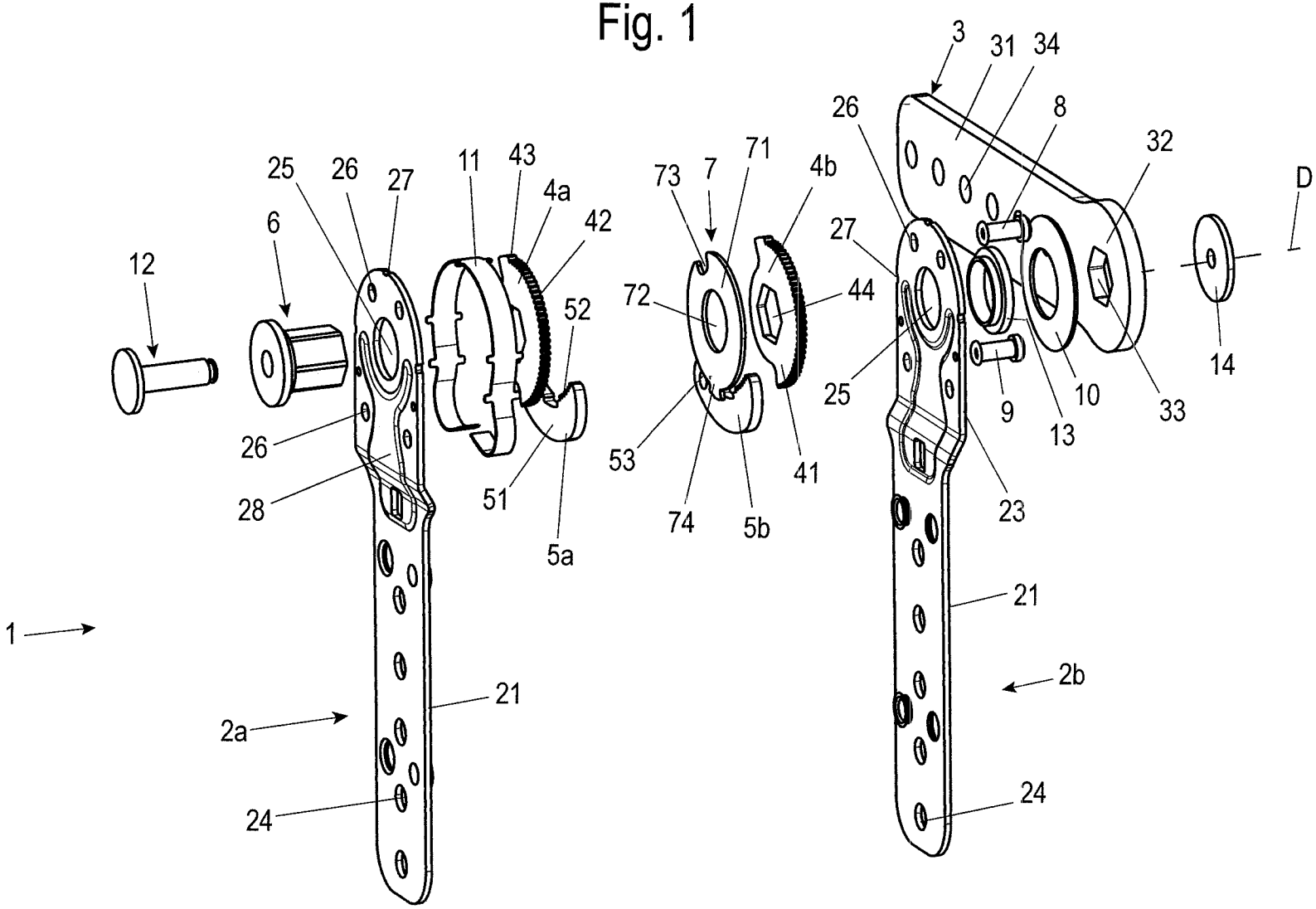

carried by the toothing, resting thereon with a friction fit, and is mounted so as to pivot about a switching angle relative to the first lever.

18 Claims, 32 Drawing Sheets

(58) Field of Classification Search
USPC ..... 297/367 R, 411.32, 411.38
See application file for complete search history.

(56) References Cited

U.S. PATENT DOCUMENTS 4,087,885 A * 5/1978 Gillentine ..... B60N 2/236 16/325
4,103,970 A * 8/1978 Homier ..... B60N 2/2358 297/367 R X
4,230,414 A * 10/1980 Cheshire ..... A47C 1/0308 297/411.32 X
4,384,744 A * 5/1983 Barley ..... B60N 2/236 16/327
4,435,013 A * 3/1984 Arihara ..... B60N 2/236 16/327
4,655,501 A * 4/1987 Ishigami ..... B60N 2/767 297/411.32 X
5,489,143 A * 2/1996 Adachi ..... B60N 2/767 297/411.38
5,597,209 A * 1/1997 Bart ..... B60N 2/767 297/411.38
5,664,837 A * 9/1997 Takagi ..... B60N 2/236 297/367 R
5,702,157 A * 12/1997 Hurite ..... B60N 2/767 297/411.38
5,899,533 A * 5/1999 Tatematsu ..... B60N 2/2352 297/367 R X
6,178,596 B1 * 1/2001 Choi ..... E05D 15/22 16/324
6,375,265 B1 * 4/2002 Hubner ..... B60N 2/767 297/411.32
6,609,758 B1 * 8/2003 Lefevere ..... B60N 2/763 297/411.38
6,890,034 B2 * 5/2005 Bonk ..... B60N 2/236 297/367 R
6,910,738 B2 * 6/2005 Bonk ..... B60N 2/236 16/325
8,104,141 B2 * 1/2012 Yamashita ..... B60N 2/2352 16/239
8,156,612 B2 * 4/2012 Yamashita ..... A47C 1/026 16/354
8,876,212 B2 * 11/2014 Yamada ..... B60N 2/767 297/411.32
9,790,985 B2 * 10/2017 Haug ..... A47C 1/026
2001/0020799 A1 * 9/2001 Bullesbach ..... B60N 2/767 297/411.38
2002/0008419 A1 * 1/2002 Boltze ..... B60N 2/433 297/367 R
2002/0050733 A1 * 5/2002 Hansel ..... B60N 2/206 297/367 R
2002/0096928 A1 * 7/2002 Bidare ..... B60N 2/767 297/411.32
2003/0025375 A1 * 2/2003 Gray ..... B60N 2/2352 297/367 R
2003/0042780 A1 * 3/2003 Klein ..... F16C 1/106 297/367 R
2003/0062755 A1 * 4/2003 Klein ..... B60N 2/20 297/367 R
2003/0160490 A1 * 8/2003 Nock ..... B60N 2/2352 297/367 R
2009/0309403 A1 12/2009 Mackert
2013/0011181 A1 1/2013 Riedmueller
2017/0367483 A1 12/2017 Fecker et al.

FOREIGN PATENT DOCUMENTS

DE 202007006758 U1 7/2007
DE 102010055529 A1 6/2012
DE 102015100527 A1 7/2016
EP 2544567 B1 2/2014
EP 2767188 A1 8/2014

OTHER PUBLICATIONS

Search Report created on Apr. 17, 2018 in related/corresponding DE Application No. 10 2017 110 246.9.
Written Opinion dated Jul. 4, 2018 in related/corresponding International Application No. PCT/EP2018/061683.

* cited by examiner a)

b)

PIVOT FITTING AND PIECE OF FURNITURE

BACKGROUND AND SUMMARY OF THE INVENTION

Exemplary embodiments of the present invention relate to a pivot fitting according to the preamble of claim 1 and a piece of furniture having such a pivot fitting.

A pivot fitting of the type in question is known, for example, from EP 2 554 567 B1. The disclosed pivot fitting includes two levers fixable in relation to one another via a catch mechanism. One of these levers can be fastened in this case on a base body or seat part of a piece of furniture, for example, a piece of upholstered furniture, while the second lever is used, for example, for fixing a pivotably mounted head support, which is fixed with the aid of the pivot fitting from a starting position in predetermined catch steps.

To change this fixing position further in the adjustment direction, the catch fitting can be pivoted further in a simple manner. In contrast, to reach a new catch position, which was already passed through during the preceding setting procedure, it is necessary to pivot the catch fitting completely into its end position and from there to pivot the catch fitting back into its base position, to subsequently pivot the catch fitting back in the initial pivot direction into the desired catch step.

Exemplary embodiments of the present invention are directed to a pivot fitting in which the adjustment procedure from a first into a second catch position can be carried out in an even simpler manner.

The pivot fitting according to the invention, in particular for movable furniture parts on pieces of furniture, comprises a first lever and a second lever, which are mounted so they are pivotable in relation to one another around a common axis from a base position by a predetermined angle.

The two levers are fixable in relation to one another in different angular positions within the predetermined angle using a clamping mechanism of the pivot fitting.

The clamping mechanism comprises in this case a toothing secured in a rotationally-fixed manner on the second lever, at least one pawl pivotably mounted on the first lever and loaded in the direction of the toothing, which is engaged with the toothing in a catch position. The clamping mechanism furthermore comprises a control disk mounted so it is rotatable around the common axis, using which the at least one pawl can be disengaged from the toothing after running over the predetermined angle from the base position in an adjustment direction, so that when the pawl is disengaged from the toothing by running over the predetermined angle in a reset direction, the two levers are pivotable back into the base position.

According to the invention, the control disk can be carried along by bearing in a friction-locked manner on the toothing and is mounted so it is rotatable by a switching angle in relation to the first lever.

Using such a pivot fitting, it is now made possible in the case of a pivot of the levers in relation to one another in the reset direction to stop this pivot procedure in an intermediate position and to latch the levers in a desired position without the two levers first having to be pivoted back into the base position.

According to one embodiment variant, the clamping mechanism comprises a first spring element, using which the control disk is pressed in a friction-locked manner on the toothing. The first spring element is preferably formed in this case as a disk spring or spring plate.

A spring element formed in this manner is producible cost-effectively and can be installed in a simple manner in the clamping mechanism and ensures a sufficient friction-locked contact of the control disk on the toothing.

According to another embodiment variant, the control disk is formed as a disk spring or spring plate. Omitting the first spring element is thus enabled.

The friction-locked driving of the control disk with the toothing can take place in this case both directly by direct application of the control disk on the toothing and also indirectly by a friction-locked driving of the control disk by a further component connected in a rotationally-fixed manner to the toothing.

For the continuous application of force to the at least one pawl, the clamping mechanism comprises a second spring element, using which the at least one pawl can be pressed against the toothing.

According to a first advantageous embodiment variant, the toothing is formed as at least one at least partially-circular toothed pulley having outer toothing formed on a partially-circular outer edge, which is coupled via a force shaft to the second lever. The pawl comprises a pivot arm having teeth facing toward the rotational axis of the levers.

The toothing is preferably formed in this case in the form of two partially-circular toothed pulleys, wherein the control disk is arranged between the toothed pulleys, so that by way of the pressure of the first spring element on one of the partially-circular toothed pulleys, the control disk is sufficiently clamped in a friction-locked manner between the two partially-circular toothed pulleys, so that the control disk either moves along with the toothed pulleys or moves in relation to the toothed pulleys depending on the application of force.

In a corresponding manner, the pawl is preferably formed in two parts from two pawl elements, wherein one of the pawl elements is arranged in a plane with one of the toothed pulleys in each case, so that in each case one of the pawl elements is operationally connected to one of the toothed pulleys in the catch position.

For the movement of the control disk in relation to the toothed pulleys, it preferably comprises a recess in which a control bolt fastened on the first lever is accommodated. The recess is dimensioned in this case in such a way that the control bolt is displaceable by the switching angle in relation to the control disk.

A switchover contour is preferably provided spaced apart from the recess on an outer circumference of the control disk, using which the pawl is pivotable out of a catch position with the toothing into a non-catch position. In a catch position of the pawl, the switchover contour is engaged in the pawl adjacent to the teeth, which form an inner toothing, of the provided recess.

The edges of the pawl framing the recess are used in this case according to a further preferred embodiment variant as support surfaces for supporting the pawl on the switchover contour of the control disk.

This enables keeping the pawl disengaged from the toothing both during pivoting of the levers in relation to one another in the adjustment direction and also in the reset direction.

According to one preferred embodiment variant, the switchover contour is formed in such a way that, during adjustment of the levers in relation to one another in the adjustment direction from a predetermined adjustment angle, the pawl is held disengaged from the toothing on a first support surface of the switchover contour.

This enables a silent adjustment during the adjustment of the levers in relation to one another in the adjustment direction, since the pawl does not engage with the toothing due to the support on the switchover contour and thus ensures a silent adjustment.

According to an alternative embodiment variant, the switchover contour is formed in such a way that the pawl is guided touching the toothing during adjustment of the levers in relation to one another in the adjustment direction.

This variant of the switchover contour enables an audible catching of the pawl during the adjustment in the adjustment direction.

In both variants, the desired catch position is slightly overrun in each case, so that upon load of the pivot fitting and a relative pivot of the levers in the reset direction accompanying this, the pawl slips down from the switchover contour of the control disk and engages in the toothing.

According to a further alternative embodiment variant, the toothing is formed as circular inner toothing arranged on the second lever and the at least one pawl comprises a pivot arm having teeth facing away from the rotational axis of the lever.

This embodiment variant of a pivot fitting according to the invention also enables latching of the levers in relation to one another in the reset movement as well due to the control disk bearing in a friction-locked manner on the toothing.

In this embodiment variant, the control disk preferably comprises at least one oblong hole, in which a fixing and control bolt fastened on the first lever is accommodated.

The longitudinal extension of the oblong hole is dimensioned in this case in such a way that the fixing and control bolt is displaceable by the pivot angle in relation to the control disk, without moving the control disk itself in relation to the second lever at the same time.

Furthermore, in this embodiment variant, the control disk comprises, preferably spaced apart from the oblong hole, a switchover contour protruding out of the plane of the control disk in the direction of the pawl, using which the pawl is pivotable out of a catch position with the toothing into a non-catch position.

The switchover contour is preferably formed in this case as a lobe, which is stamped out of a ring disk of the control disk and bent toward the pawl. This lobe causes the fixing of the pawl in the non-catch position in this case.

The toothing itself is formed according to a further alternative embodiment variant as a circular inner toothing formed on a lever head of the second lever.

In an alternative embodiment variant, the toothing is formed as a circular toothed pulley accommodated between the lever heads of the second lever having inner toothing formed thereon.

In yet another alternative embodiment variant, the toothing and the control disk are accommodated between lever heads of the cover, wherein the second spring element is arranged between the lever heads, circumferentially enclosing the toothing and the control disk. The second spring element thus enables, in addition to the contact pressure of the pawl, the protection of the toothing, the control disk, and the pawl from dirt, which further extends the service life of the pivot fitting.

BRIEF DESCRIPTION OF THE DRAWING FIGURES

Figure 2:
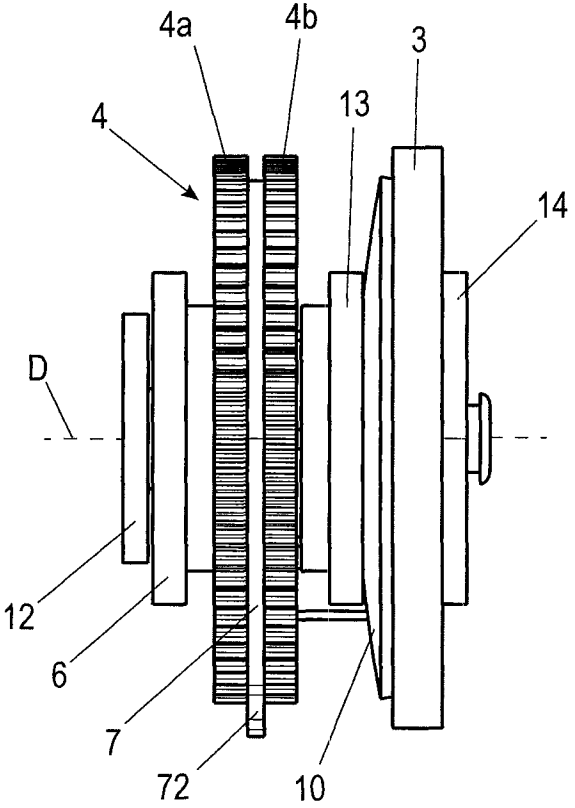
Figure 3:
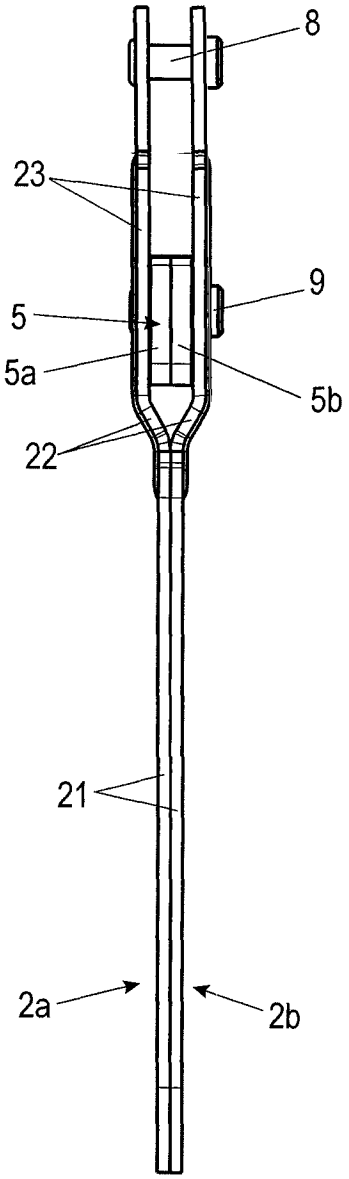
Figure 4:
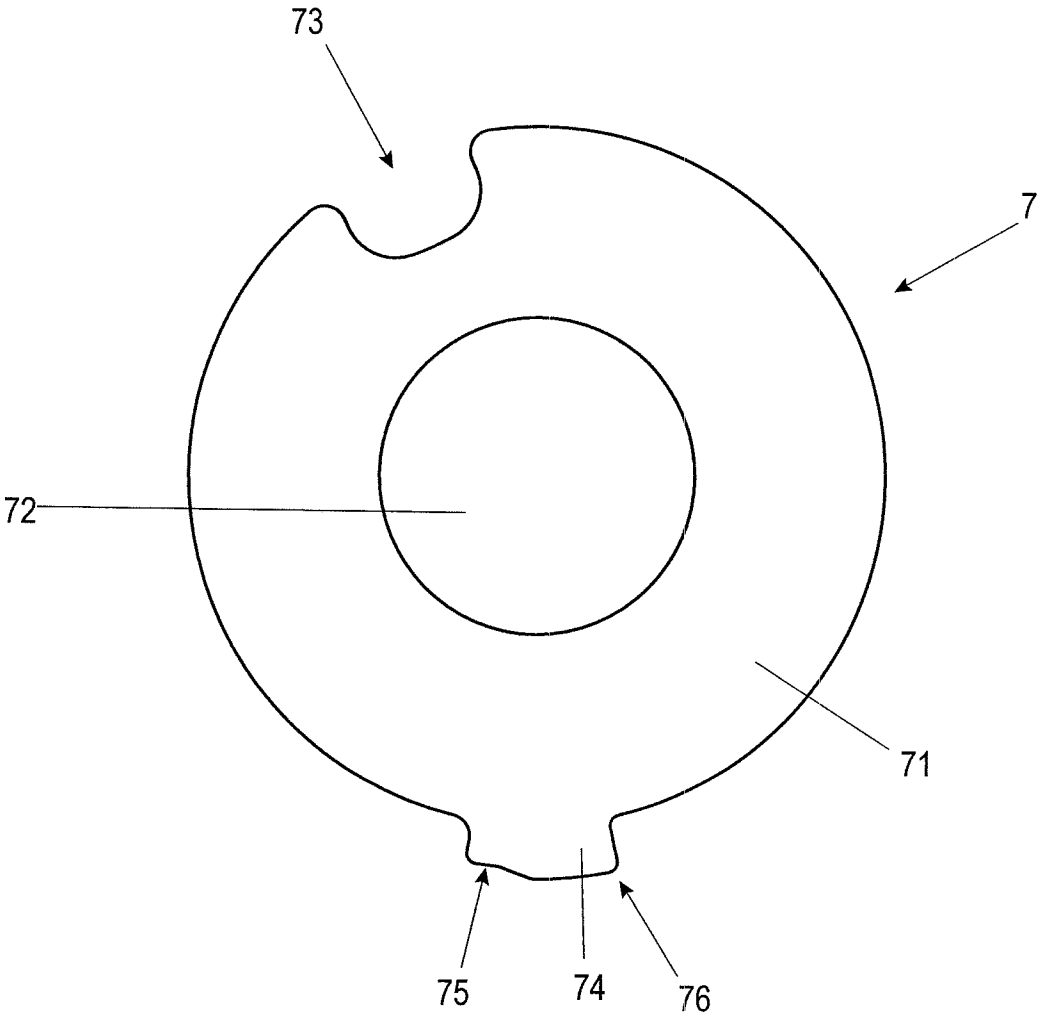
Figure 5:
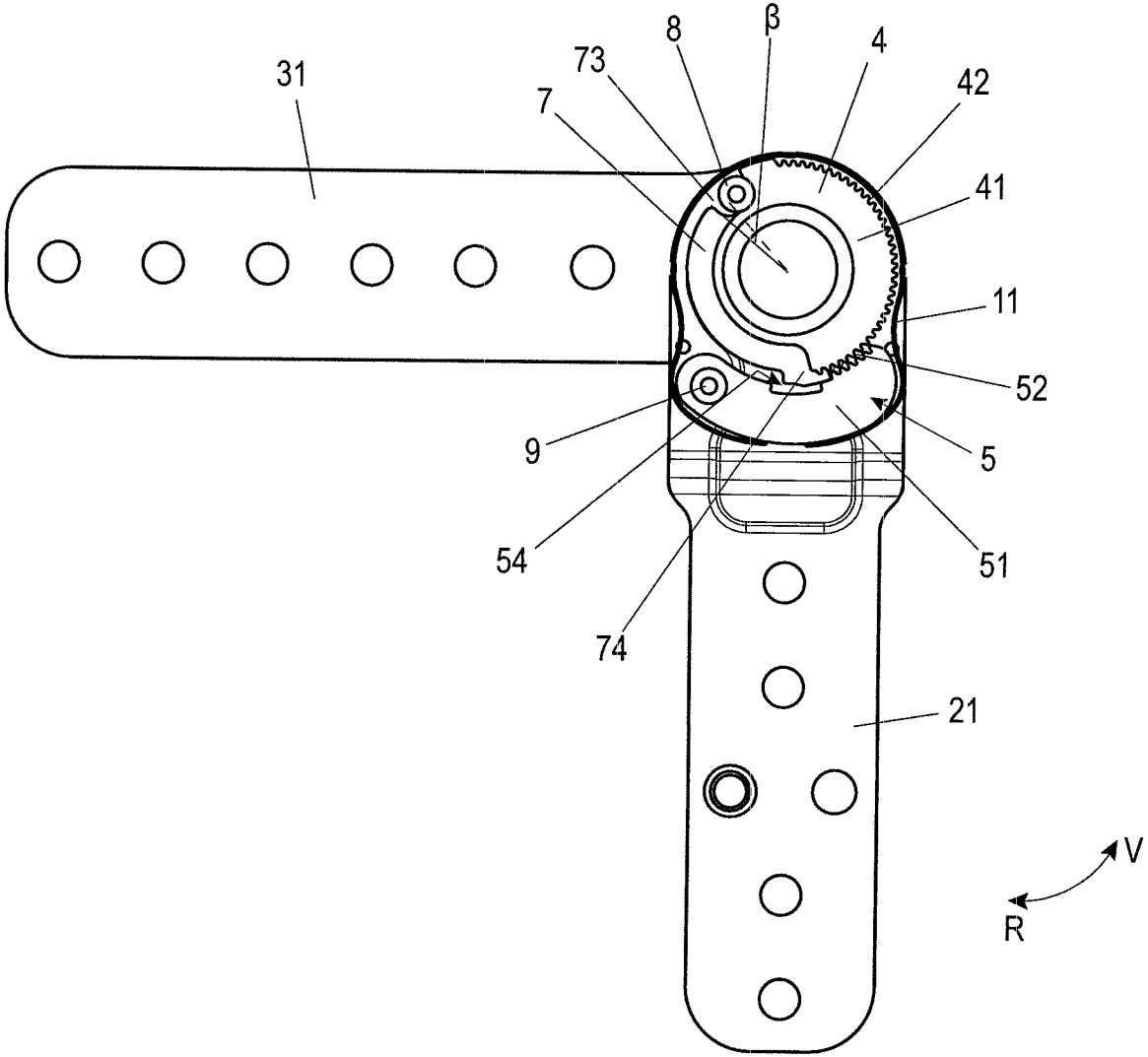
Figure 6:
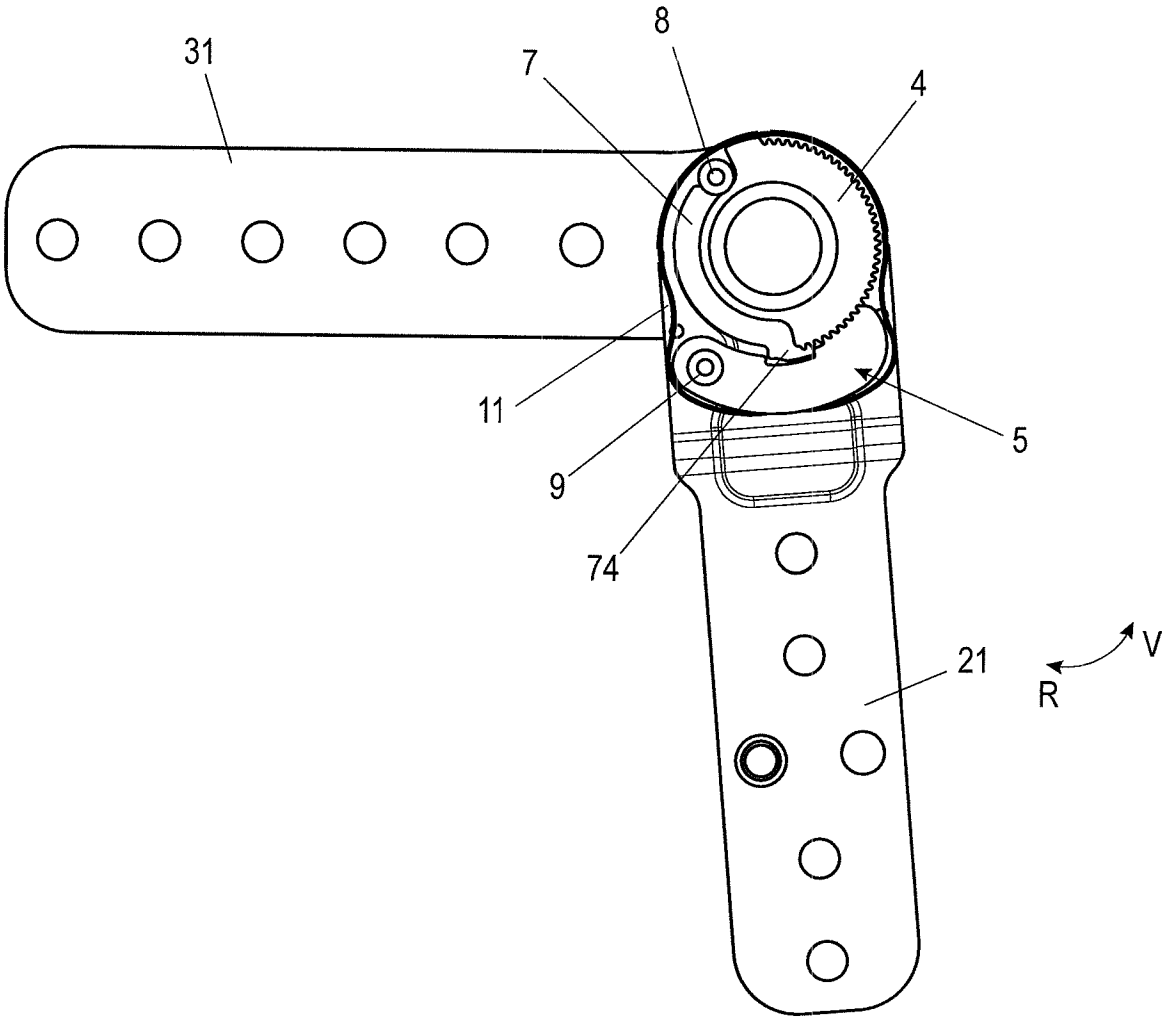
Figure 7:
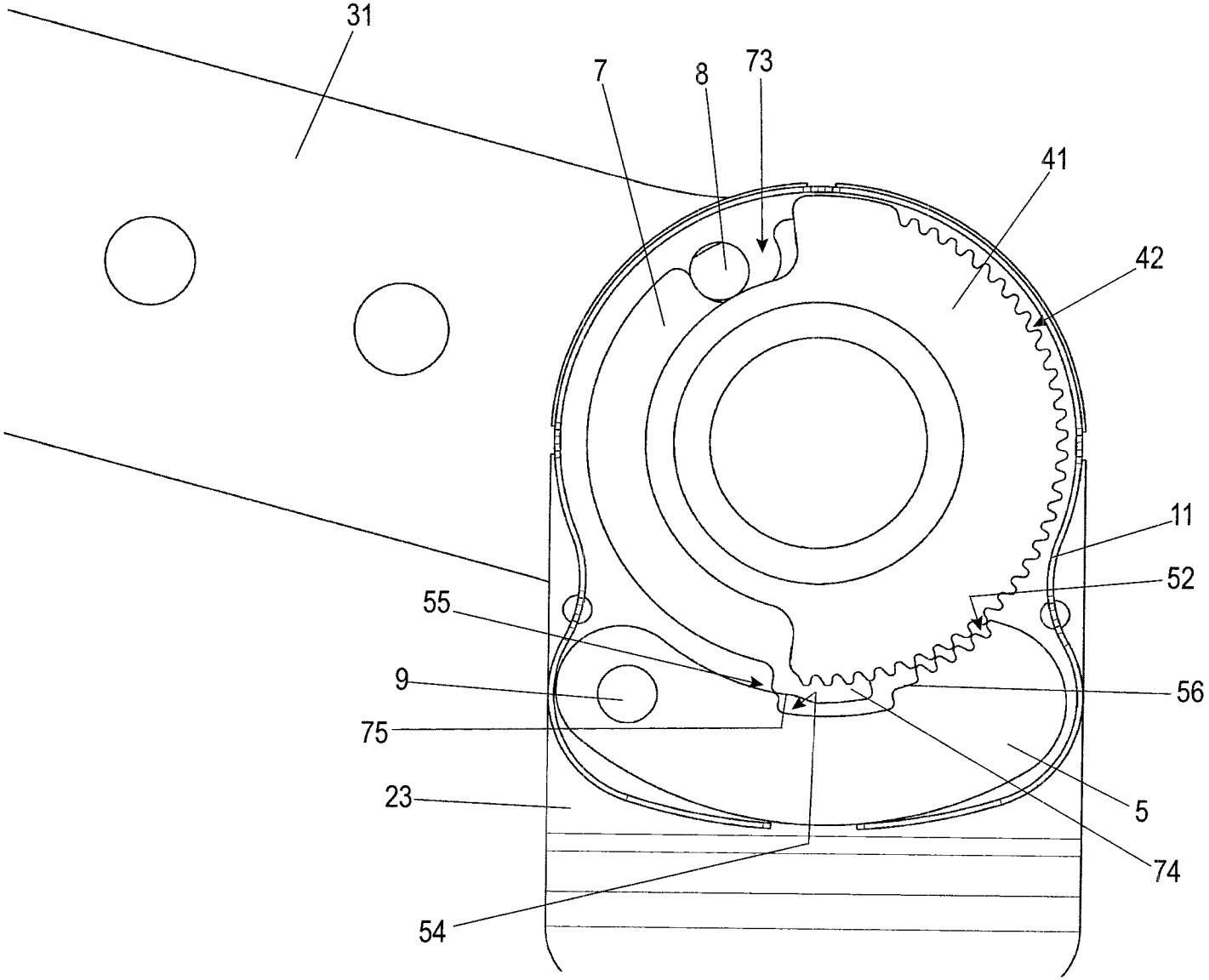
Figure 8:
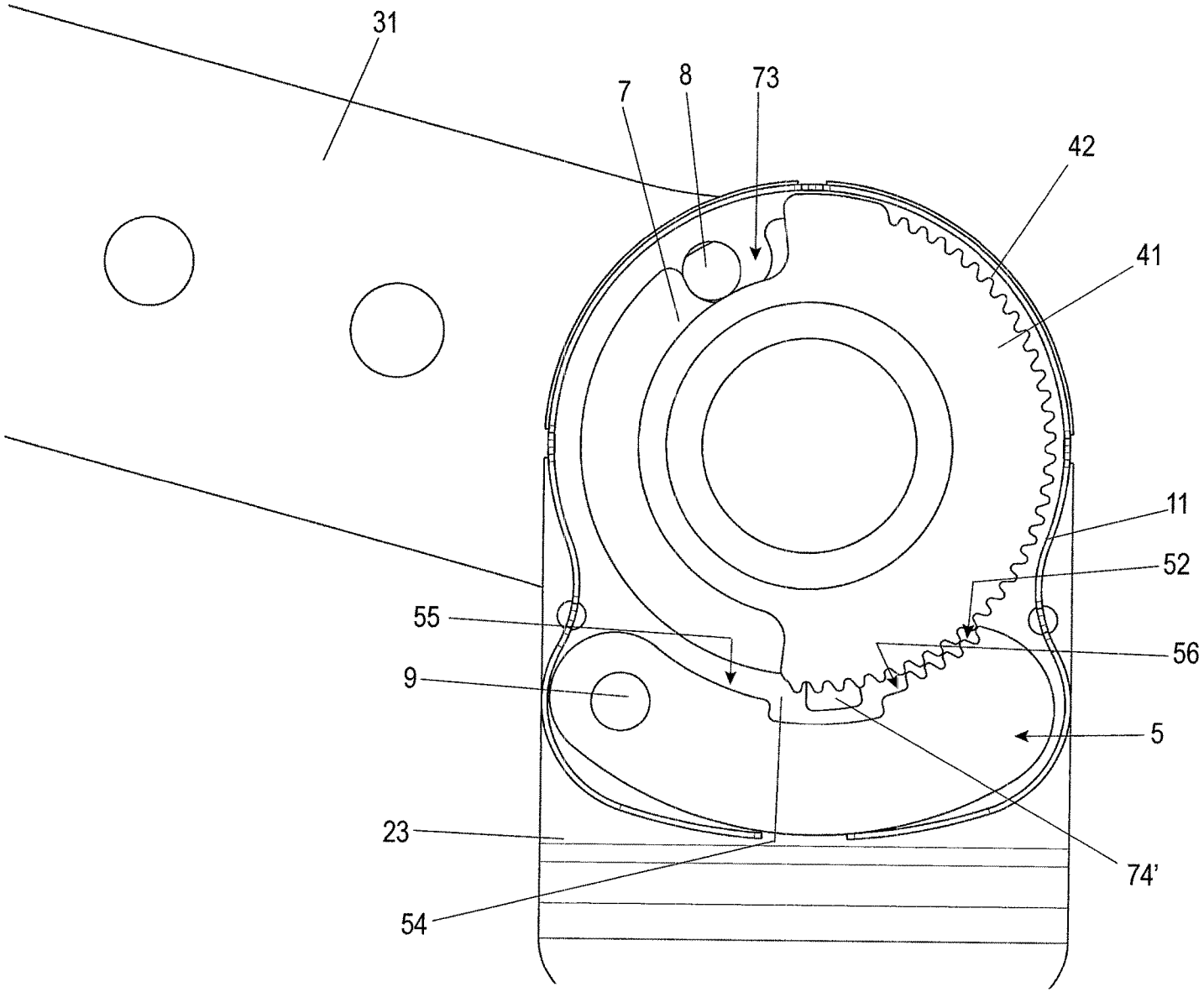
Figure 9:
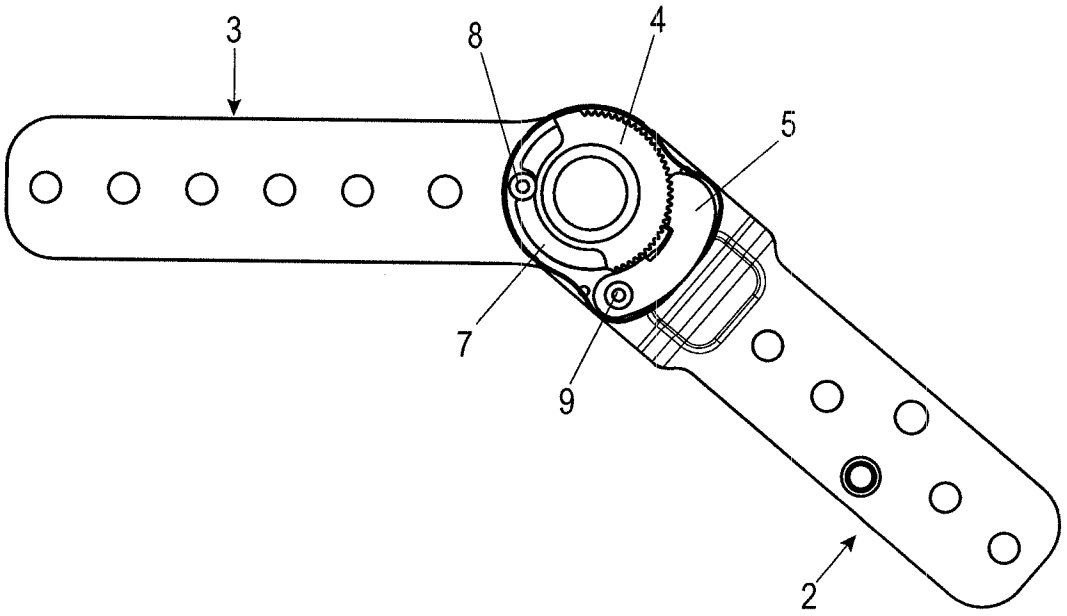
Figure 10:
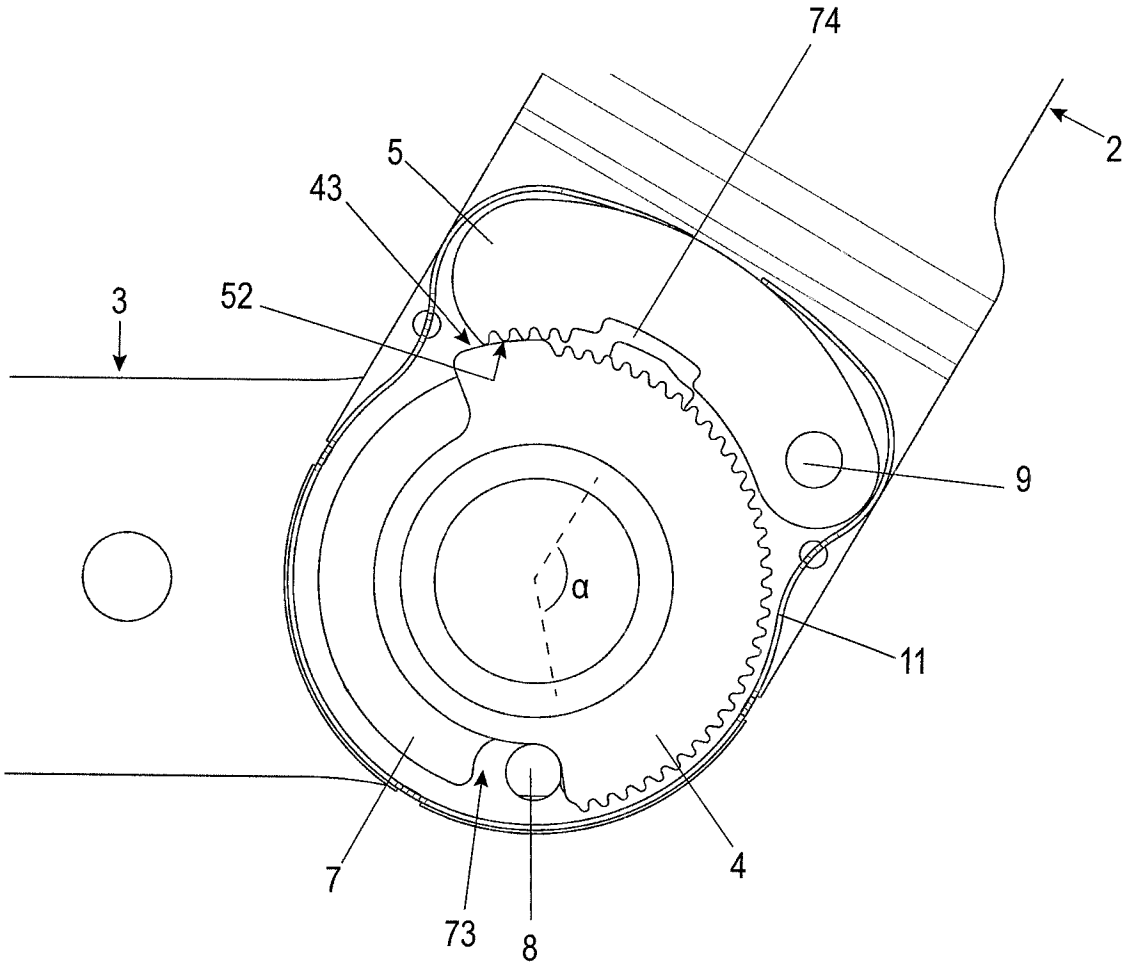
Figure 11:
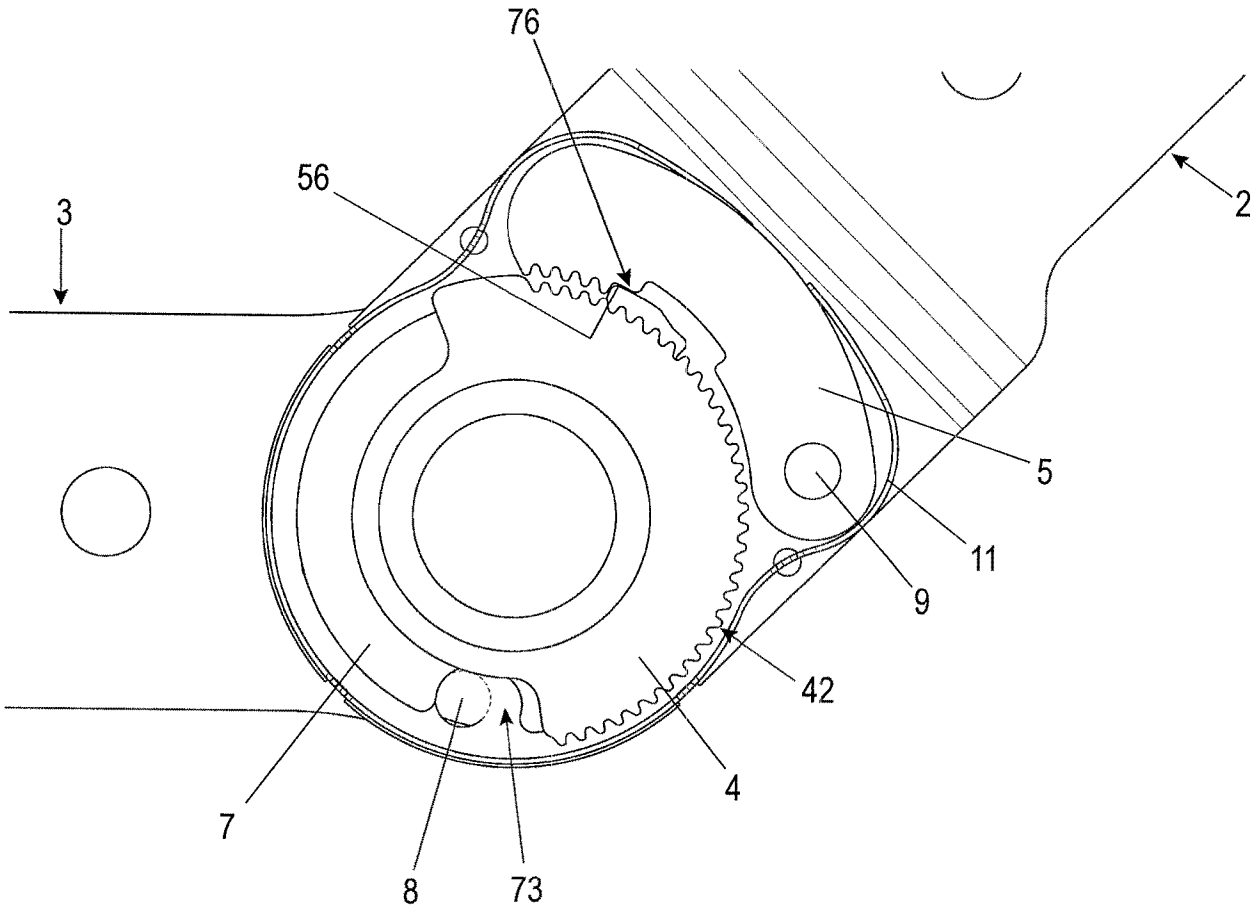
Figure 12:
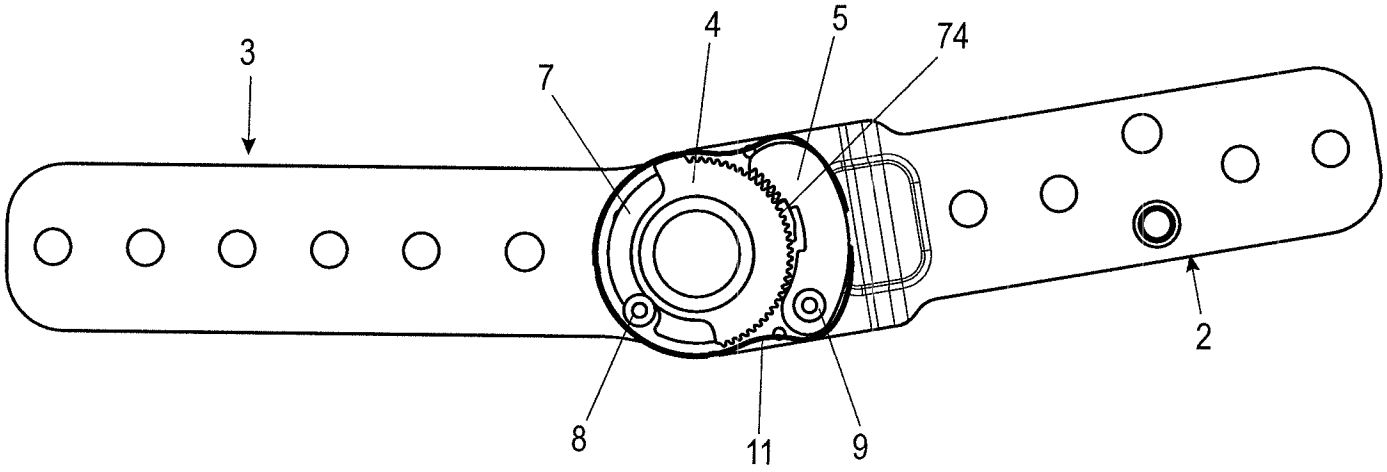
Figure 13:
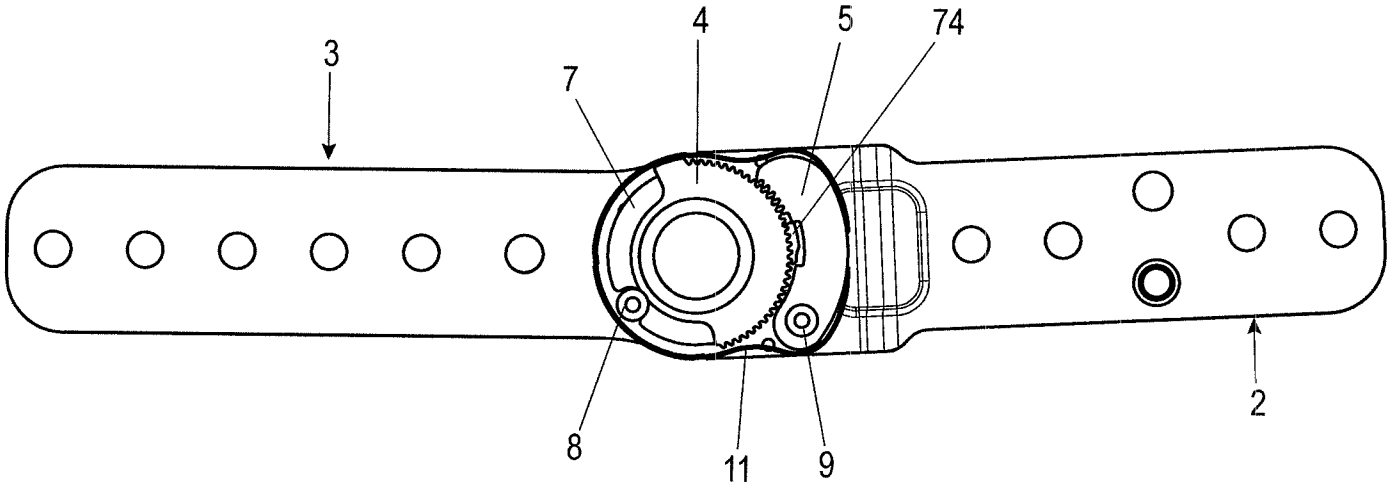
Figure 14:
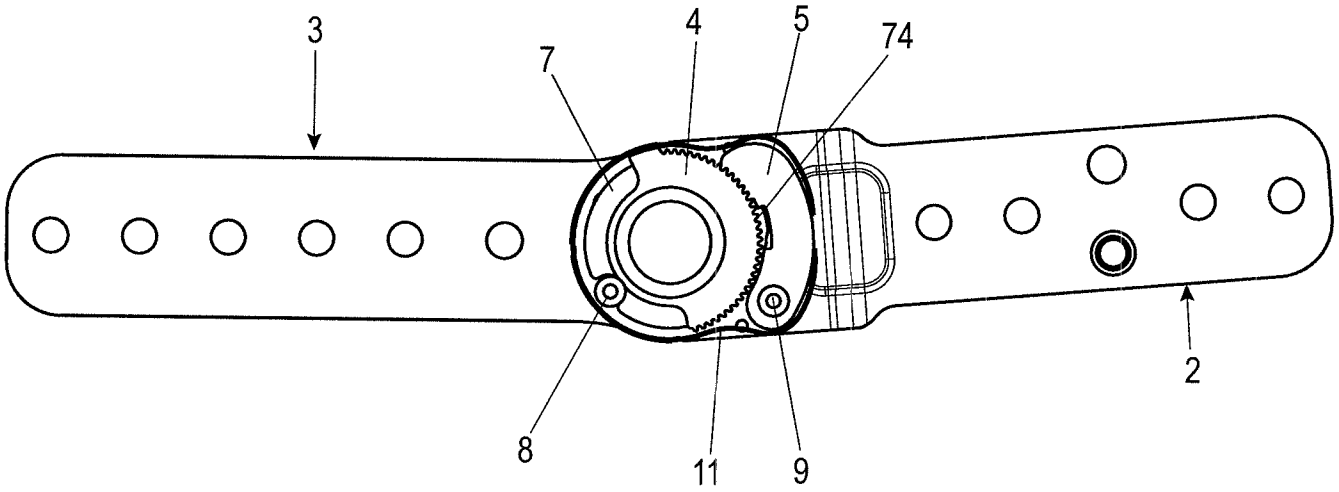
Figure 15:
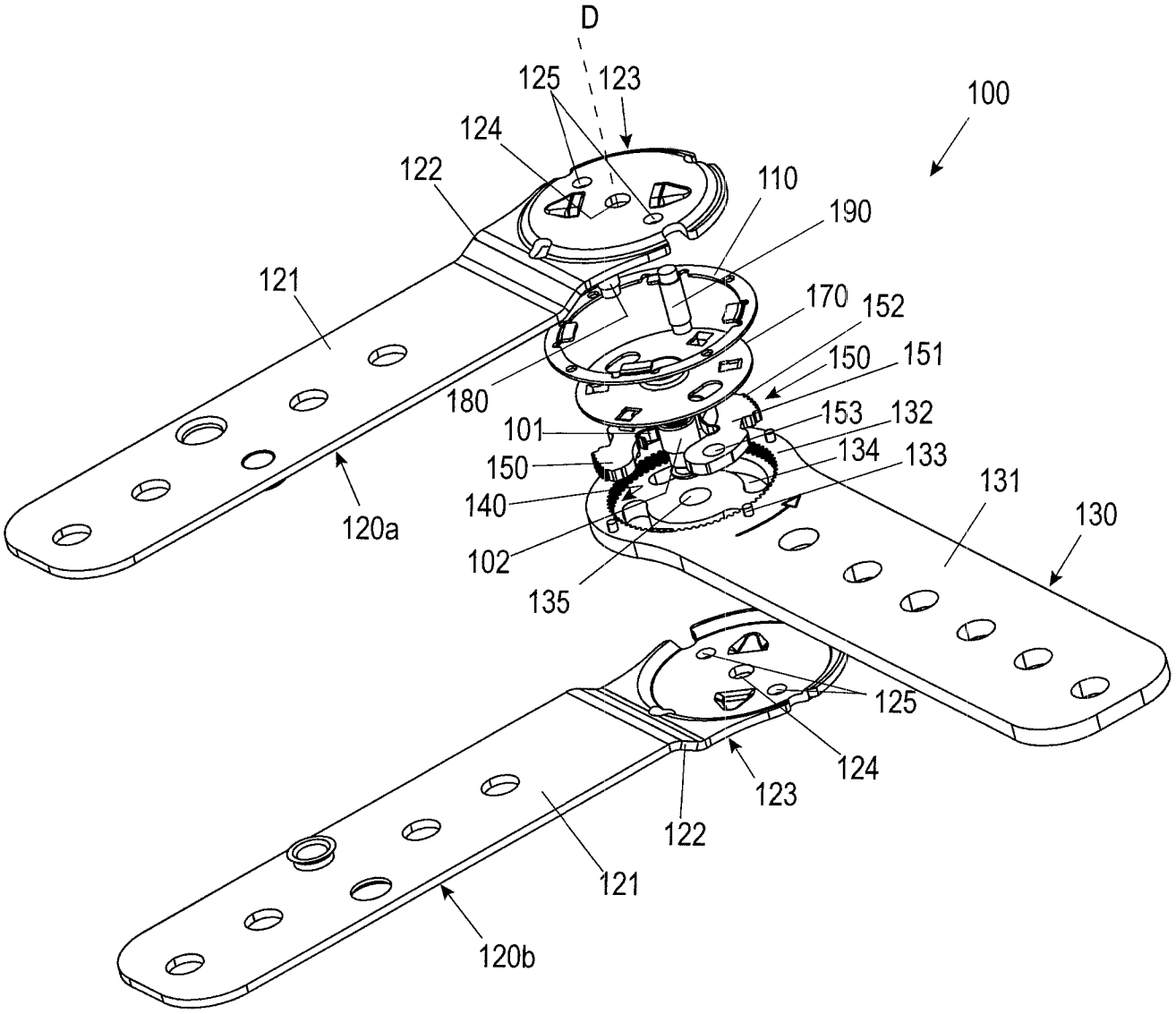
Figure 16:
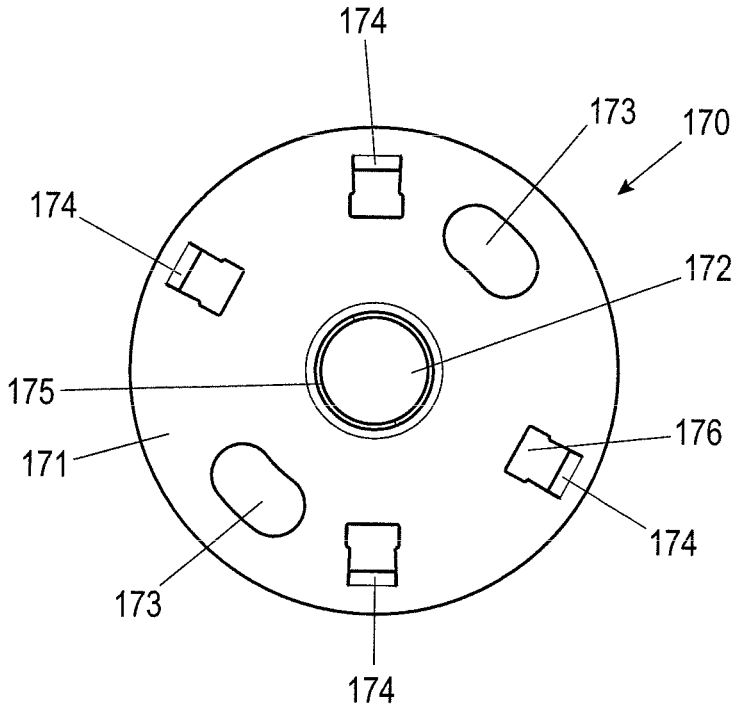
Figure 16:
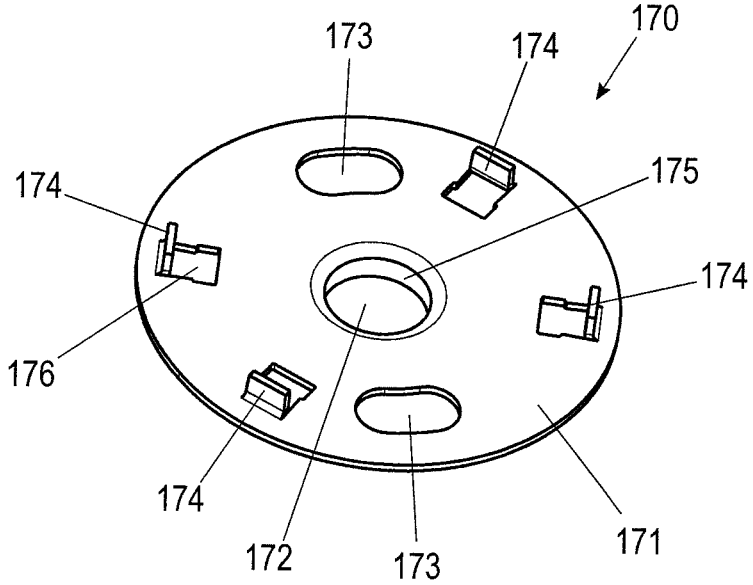
Figure 17:
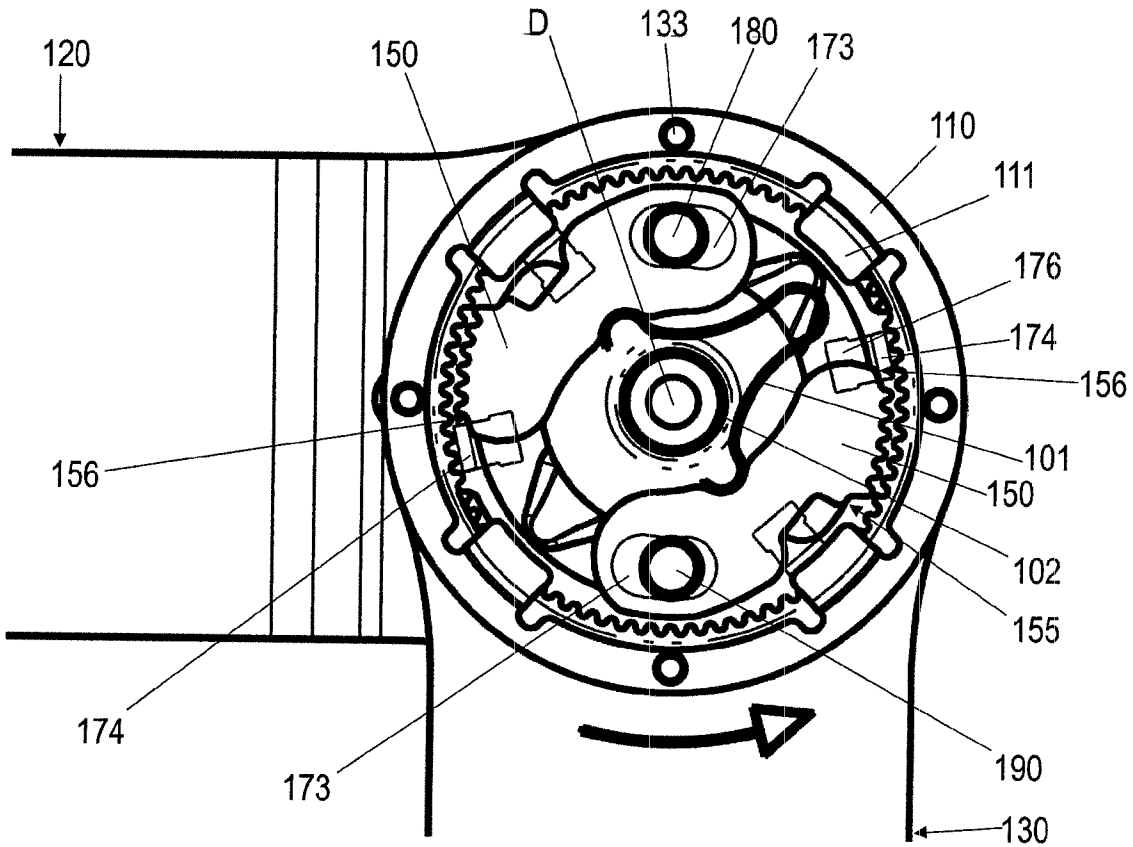
Figure 18:
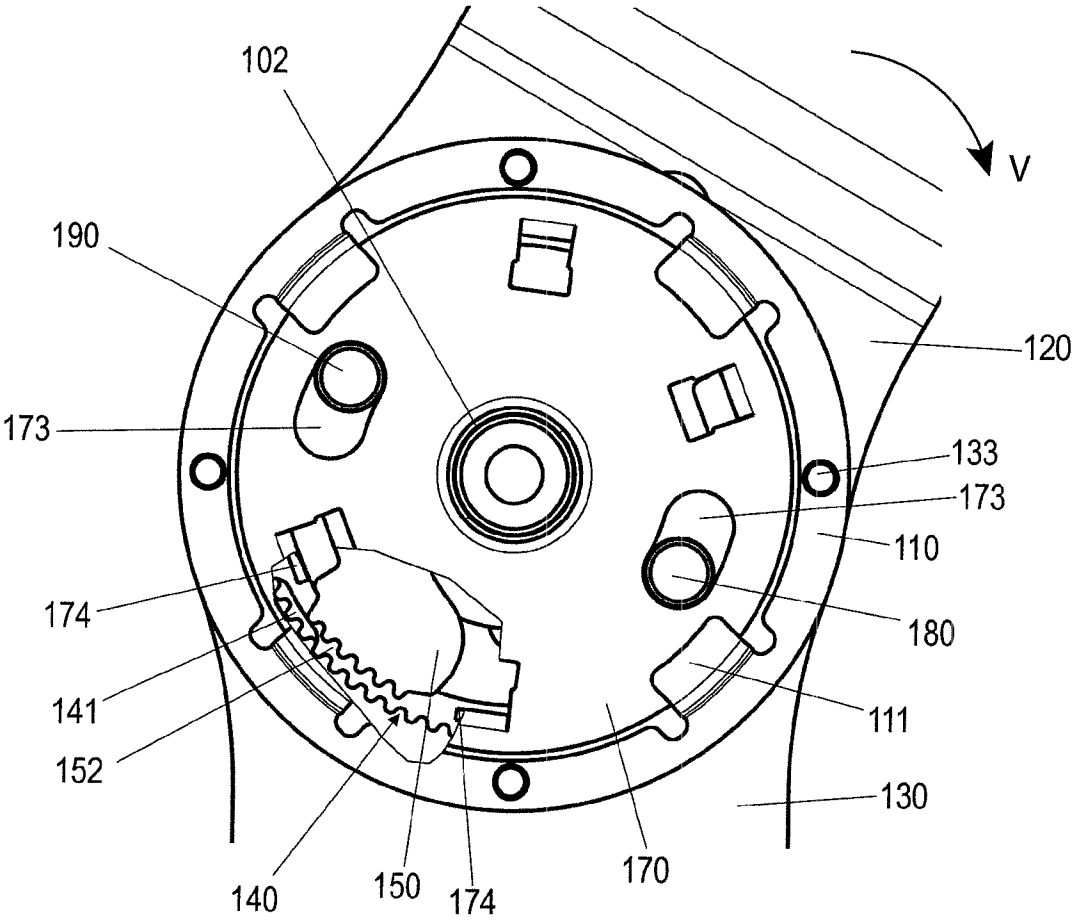
Figure 19:
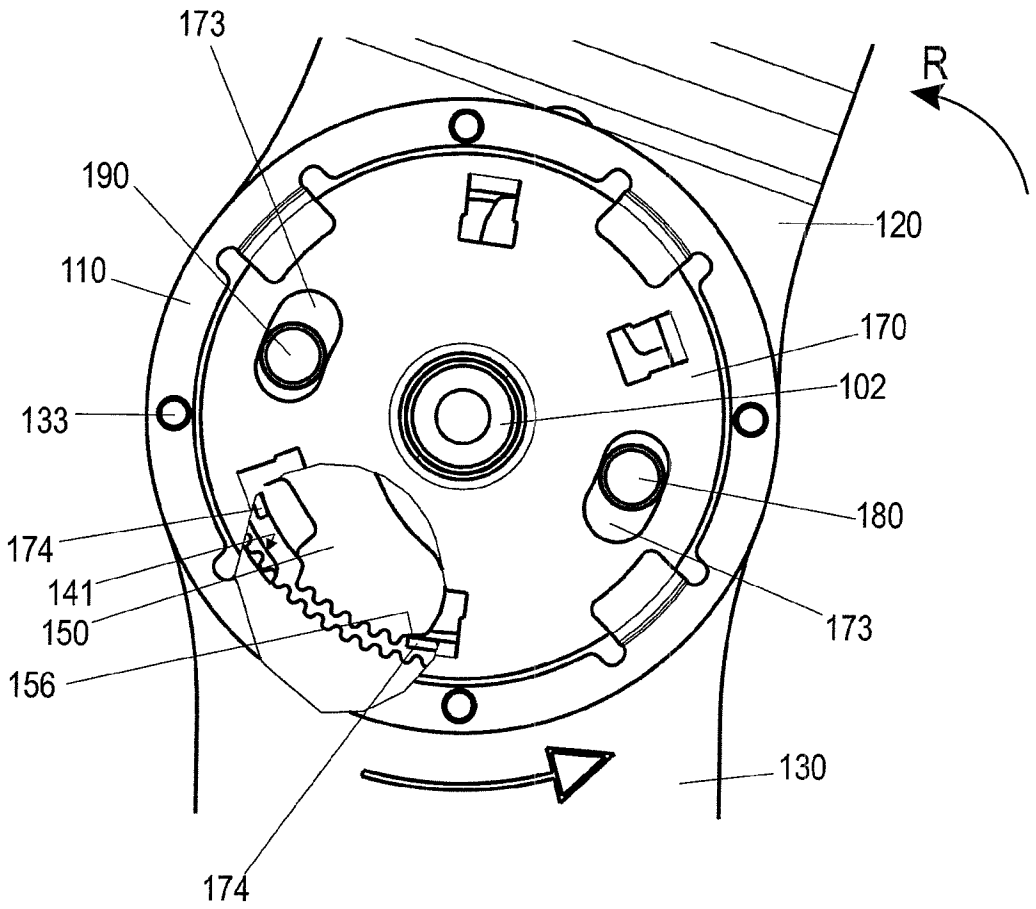
Figure 20:
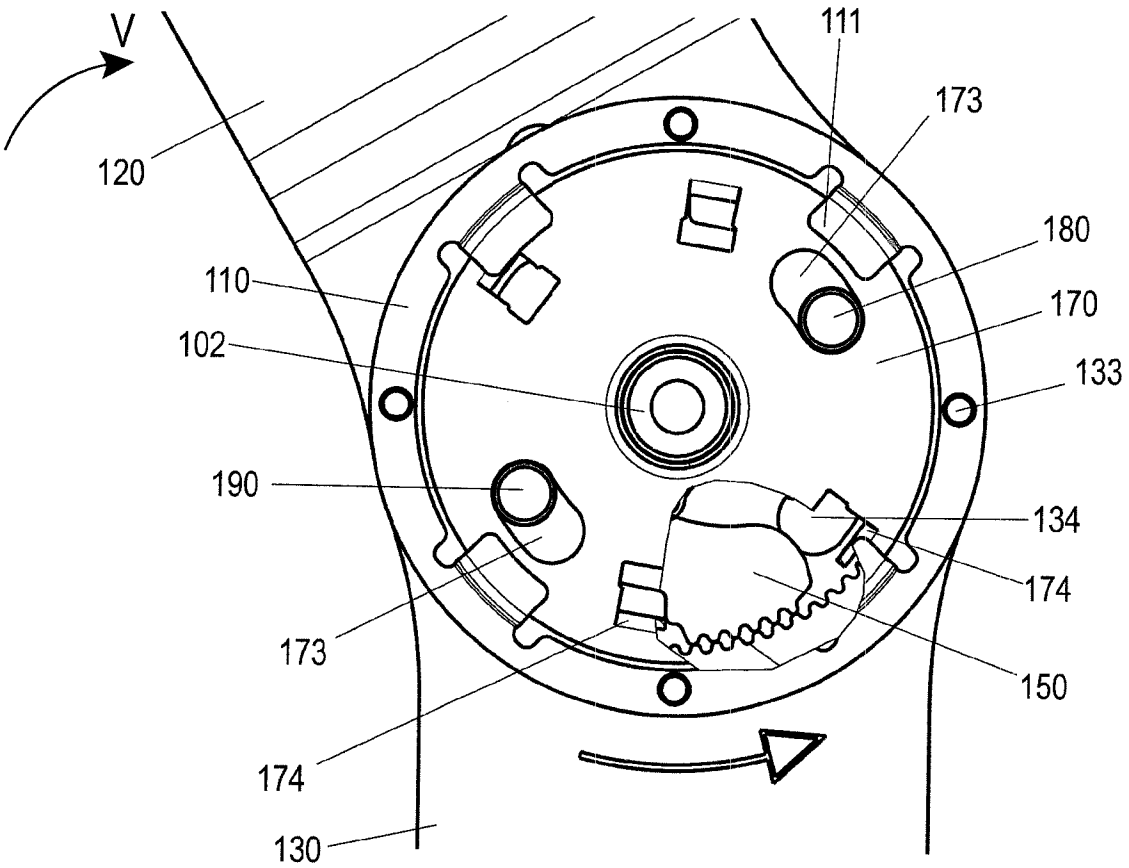
Figure 21:
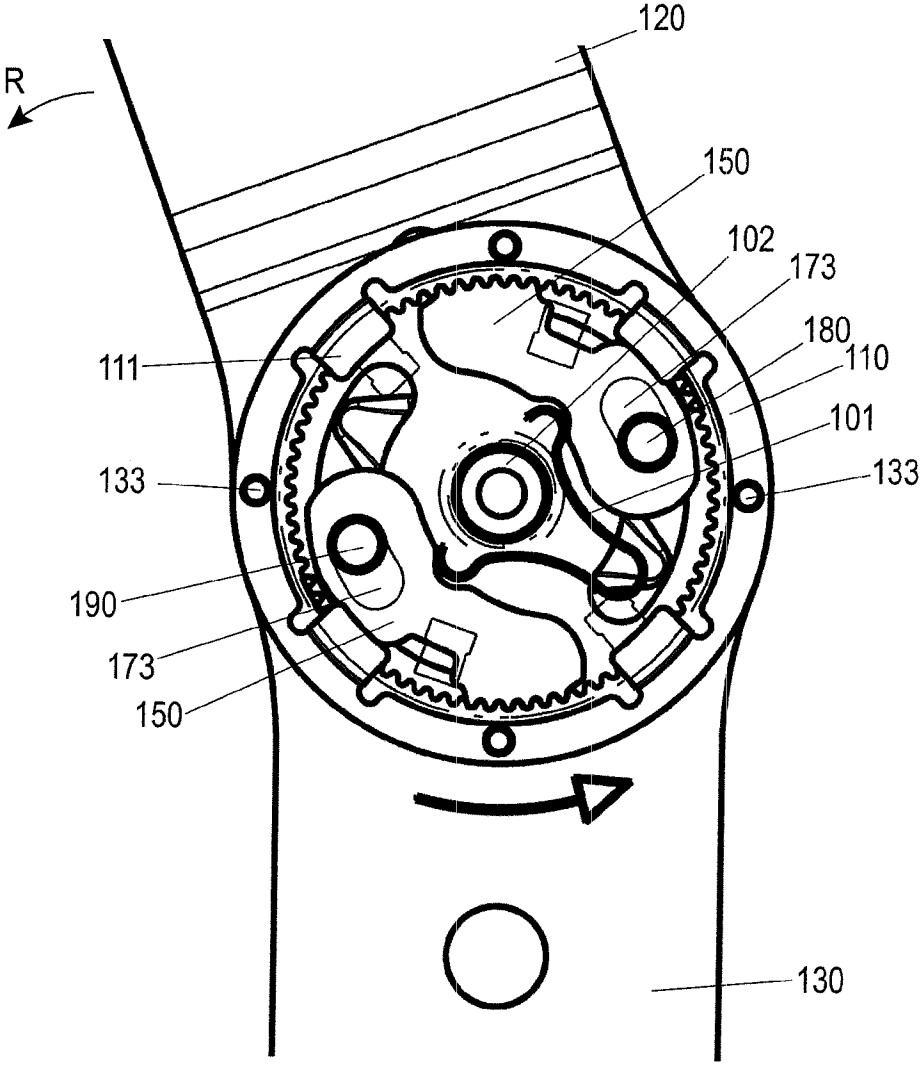
Figure 22:
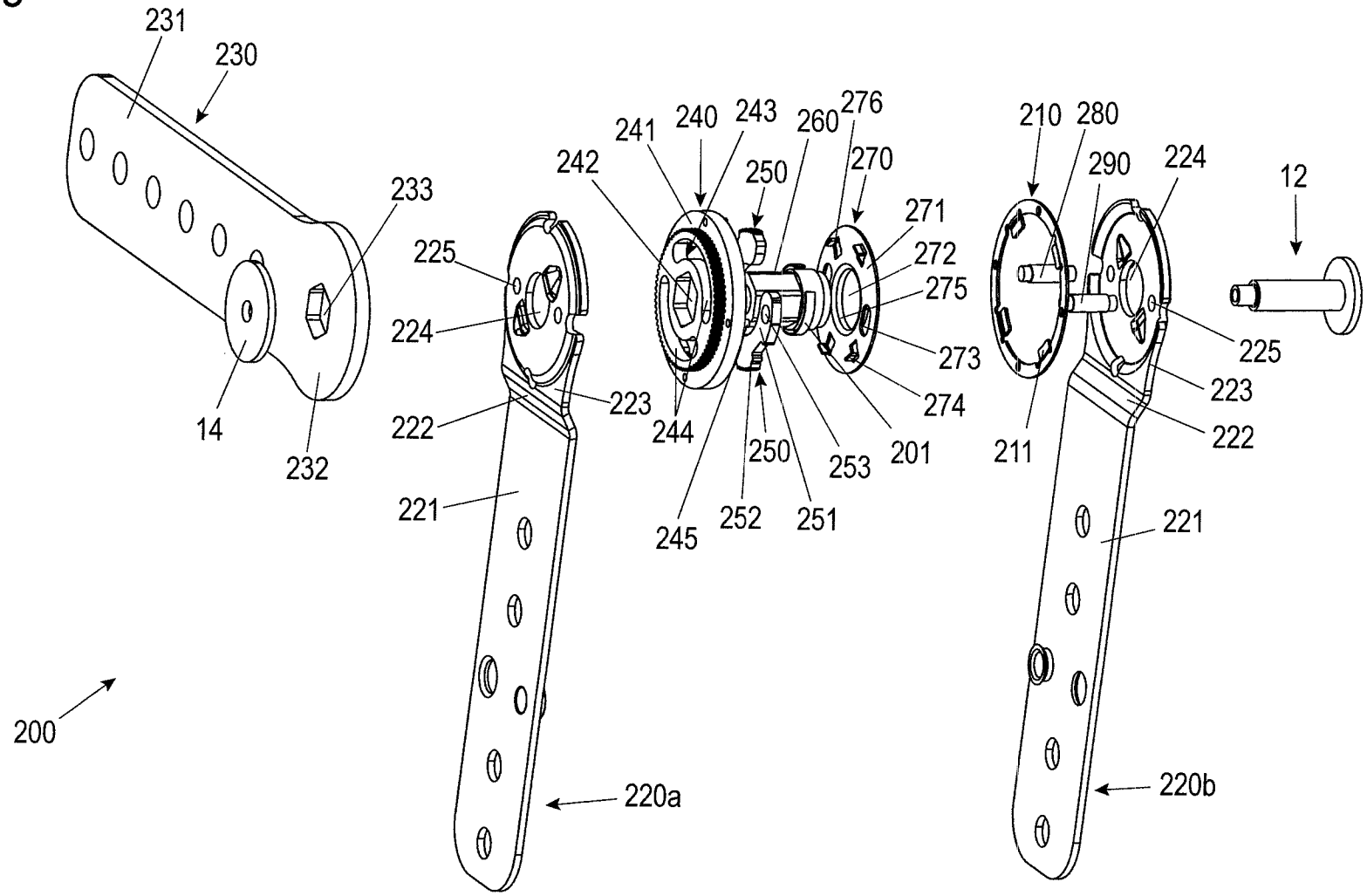
Figure 23:
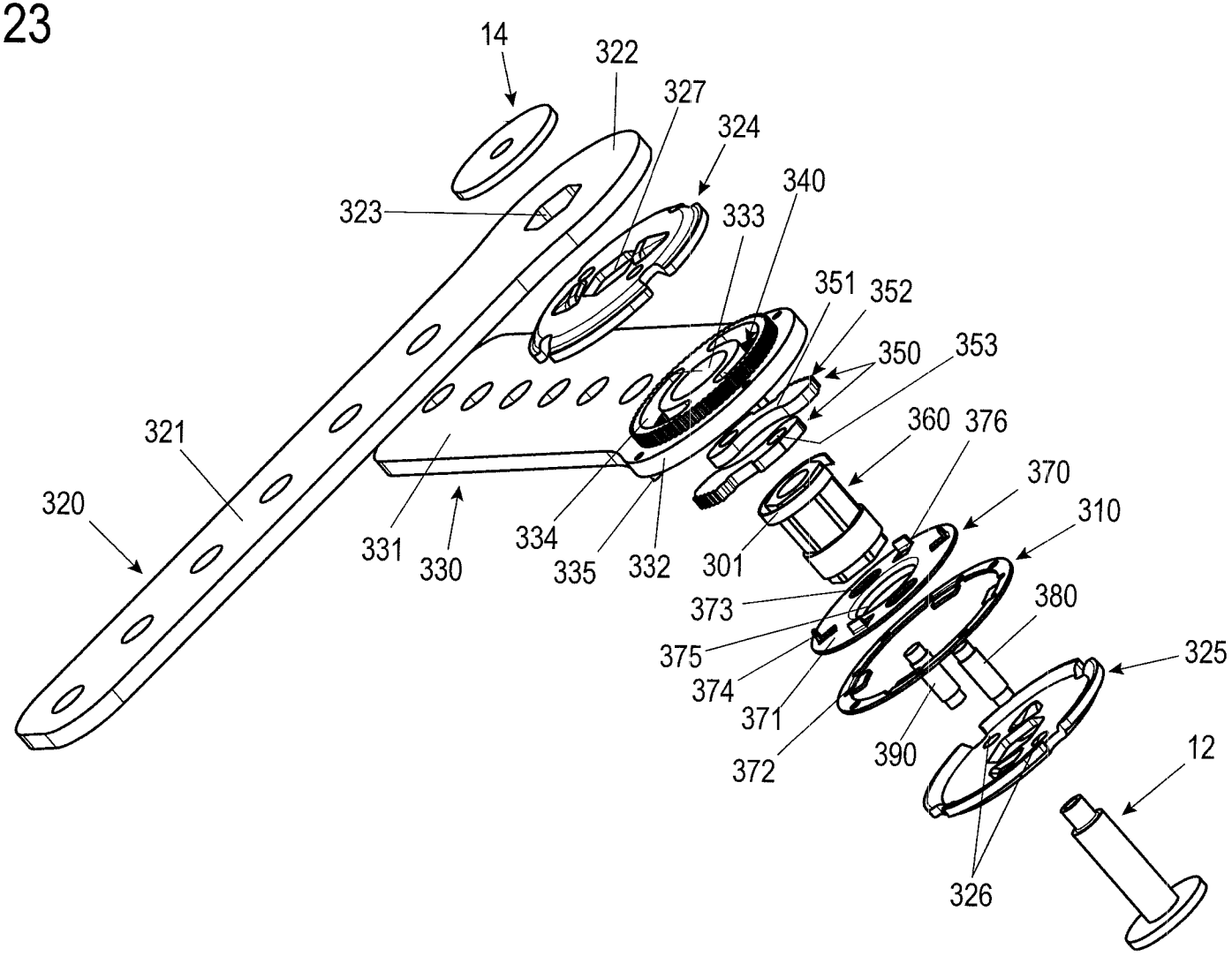
Figure 24:
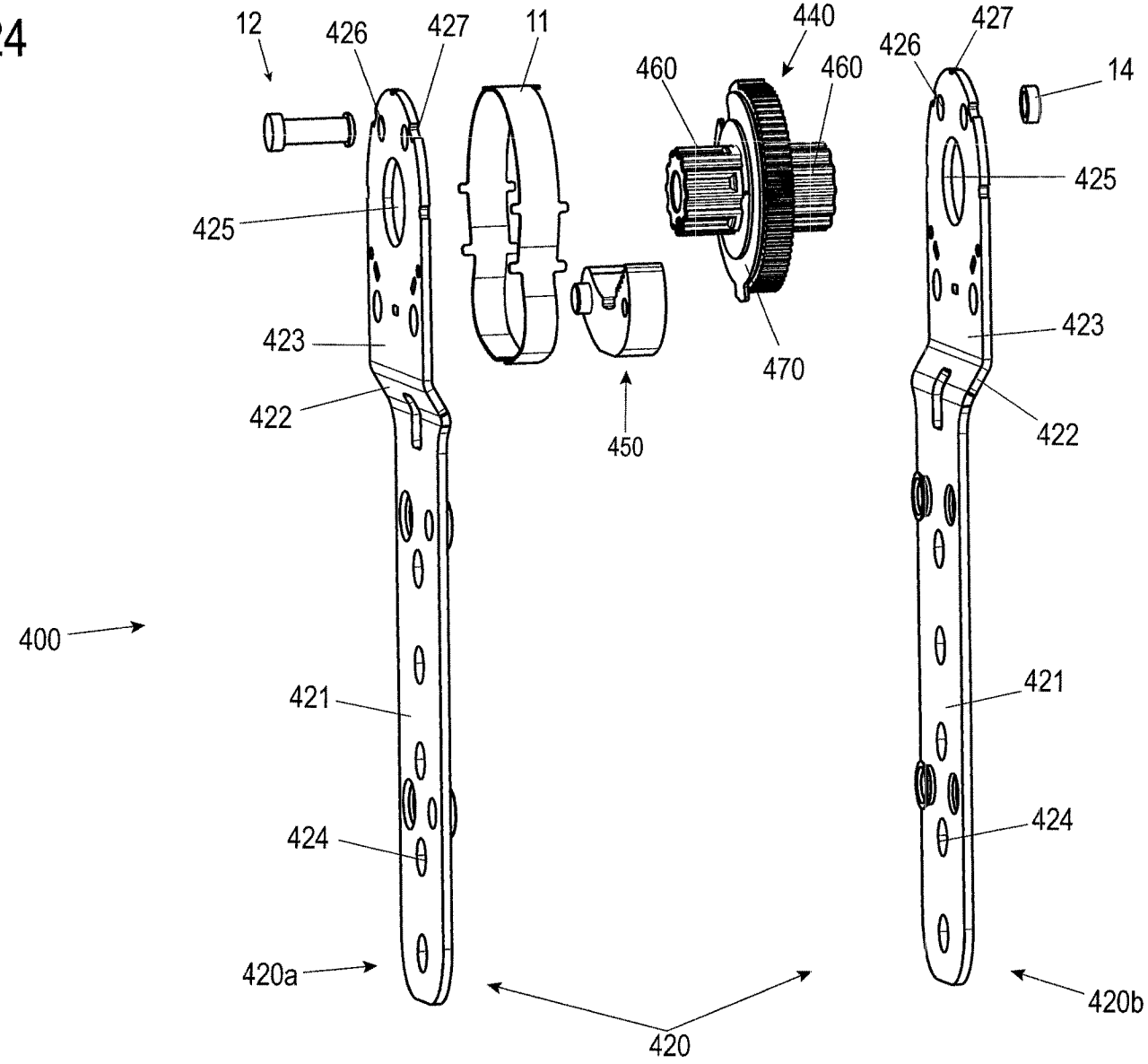
Figure 25:
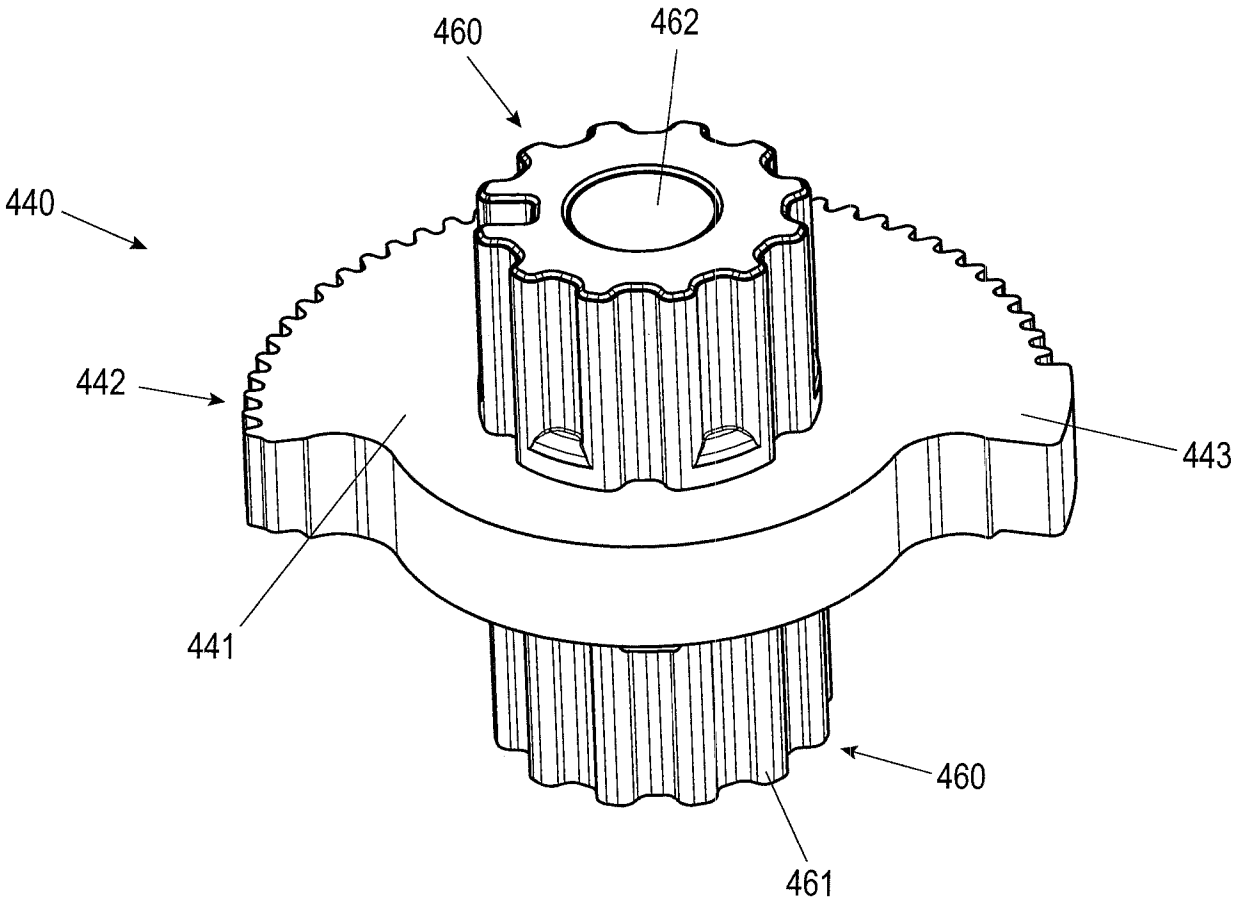
Figure 26:
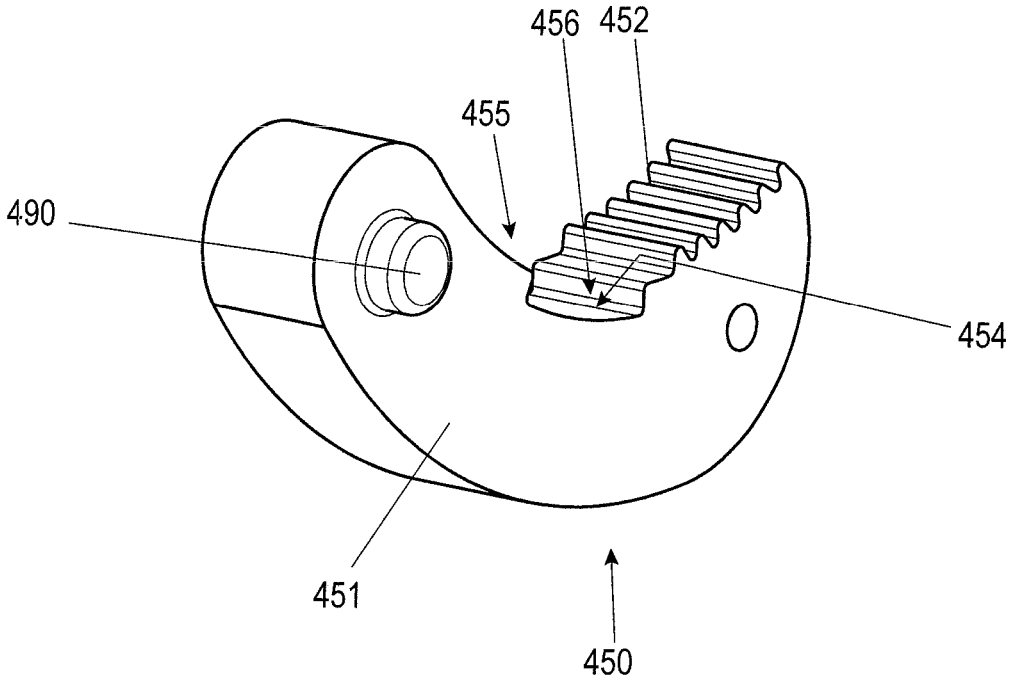
Figure 27:
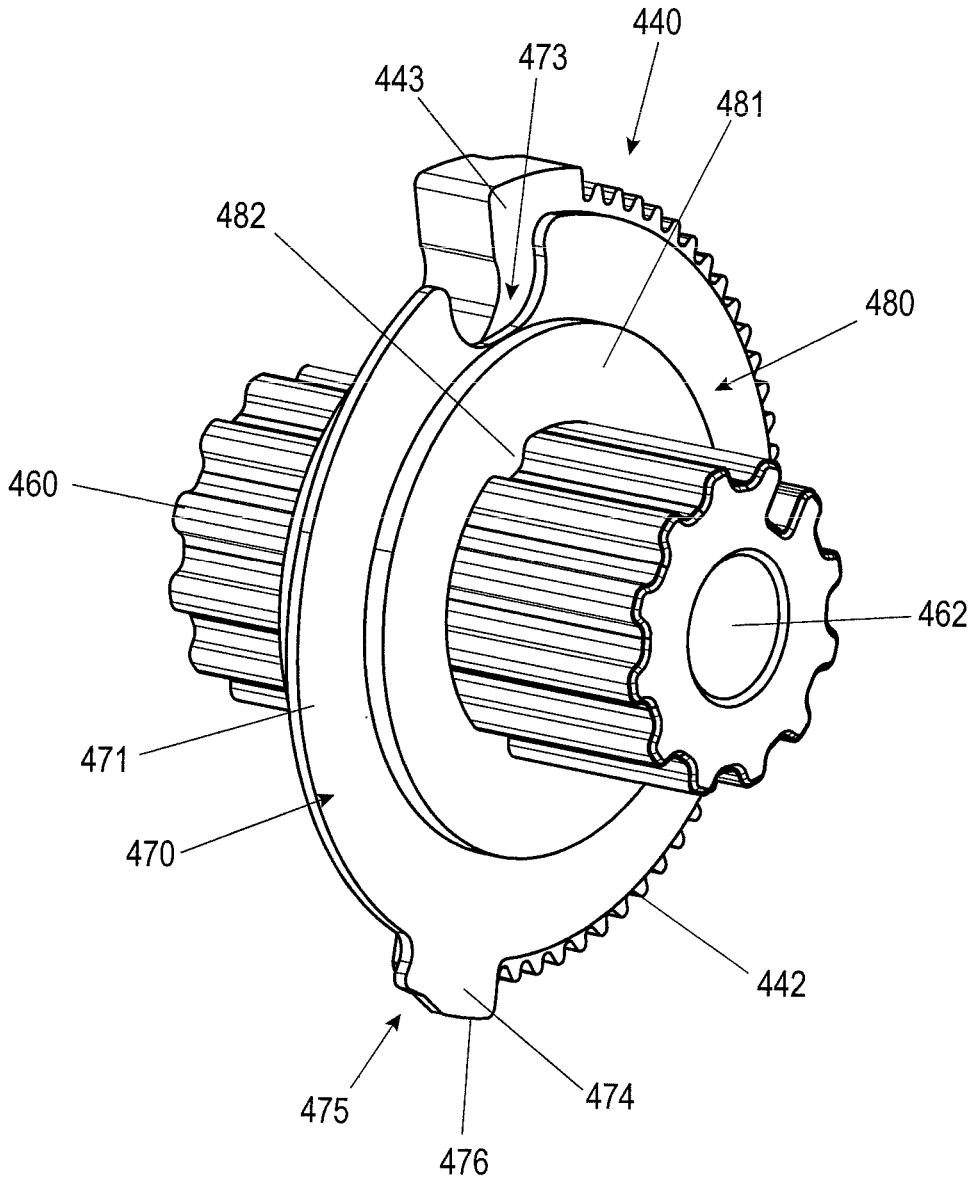
Figure 28:
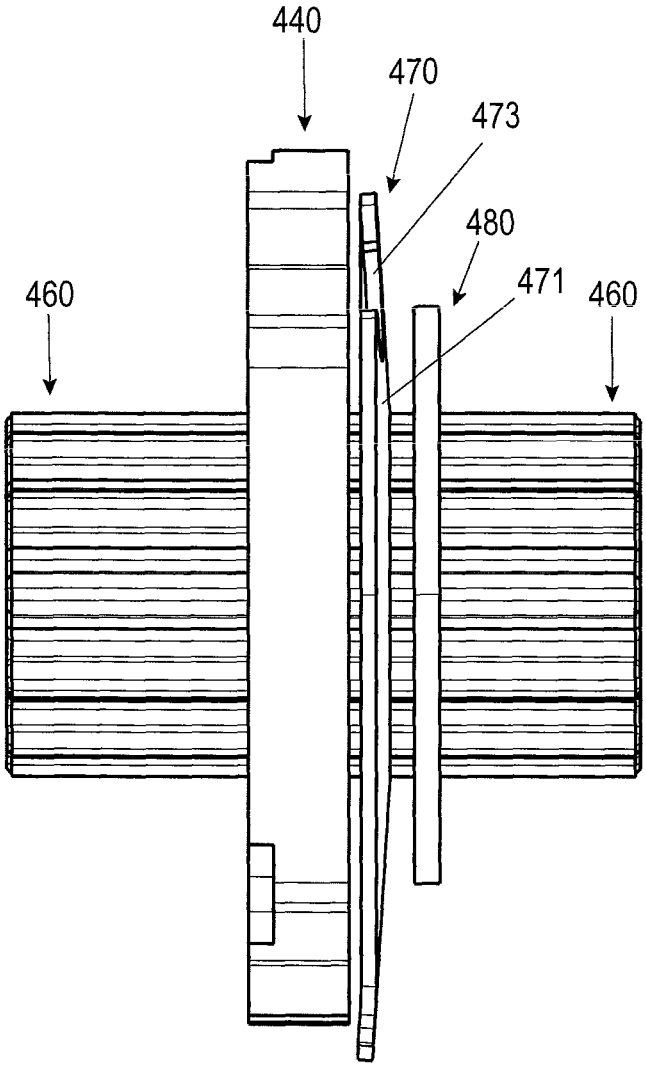
Figure 29:
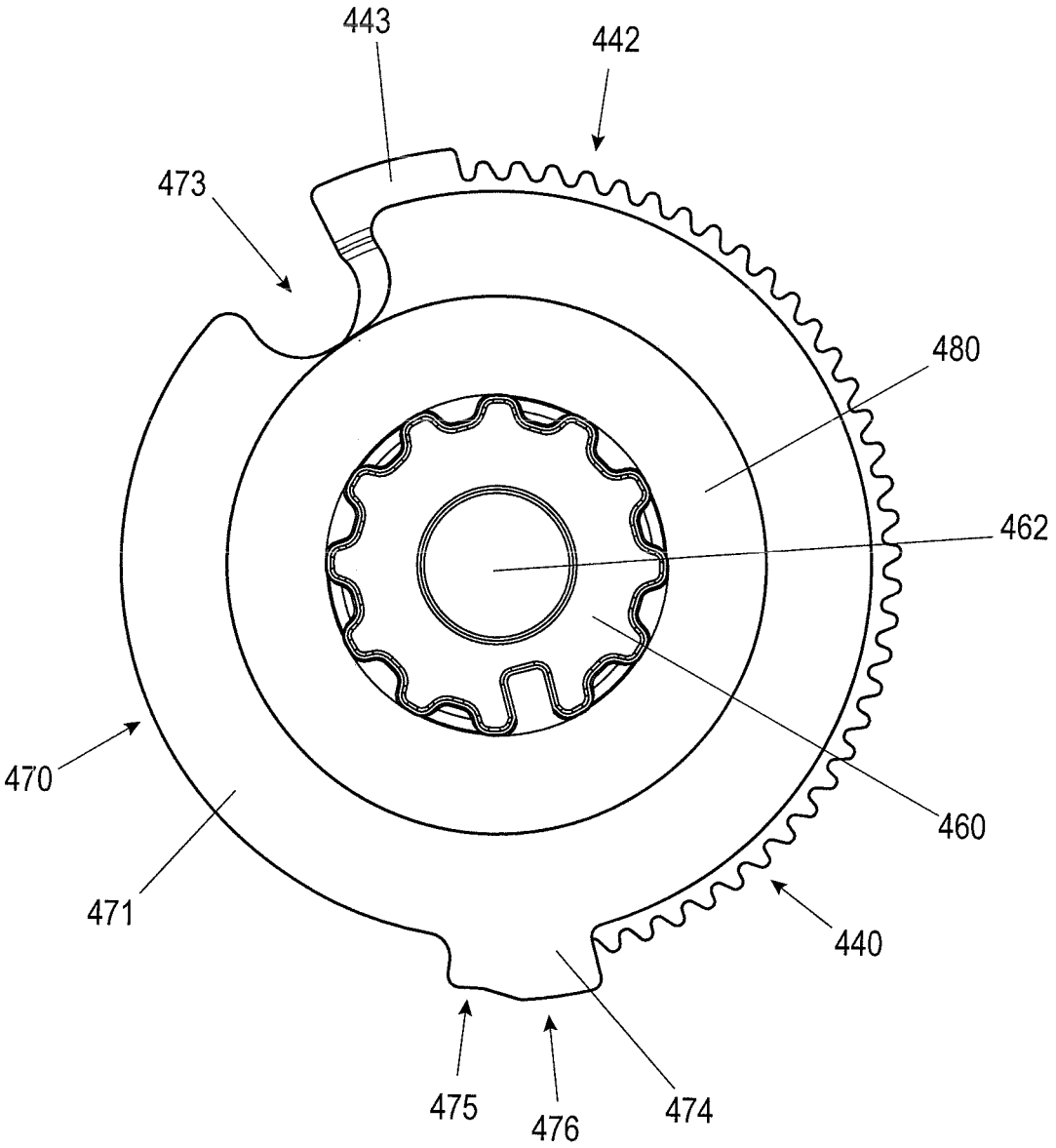
Figure 30:
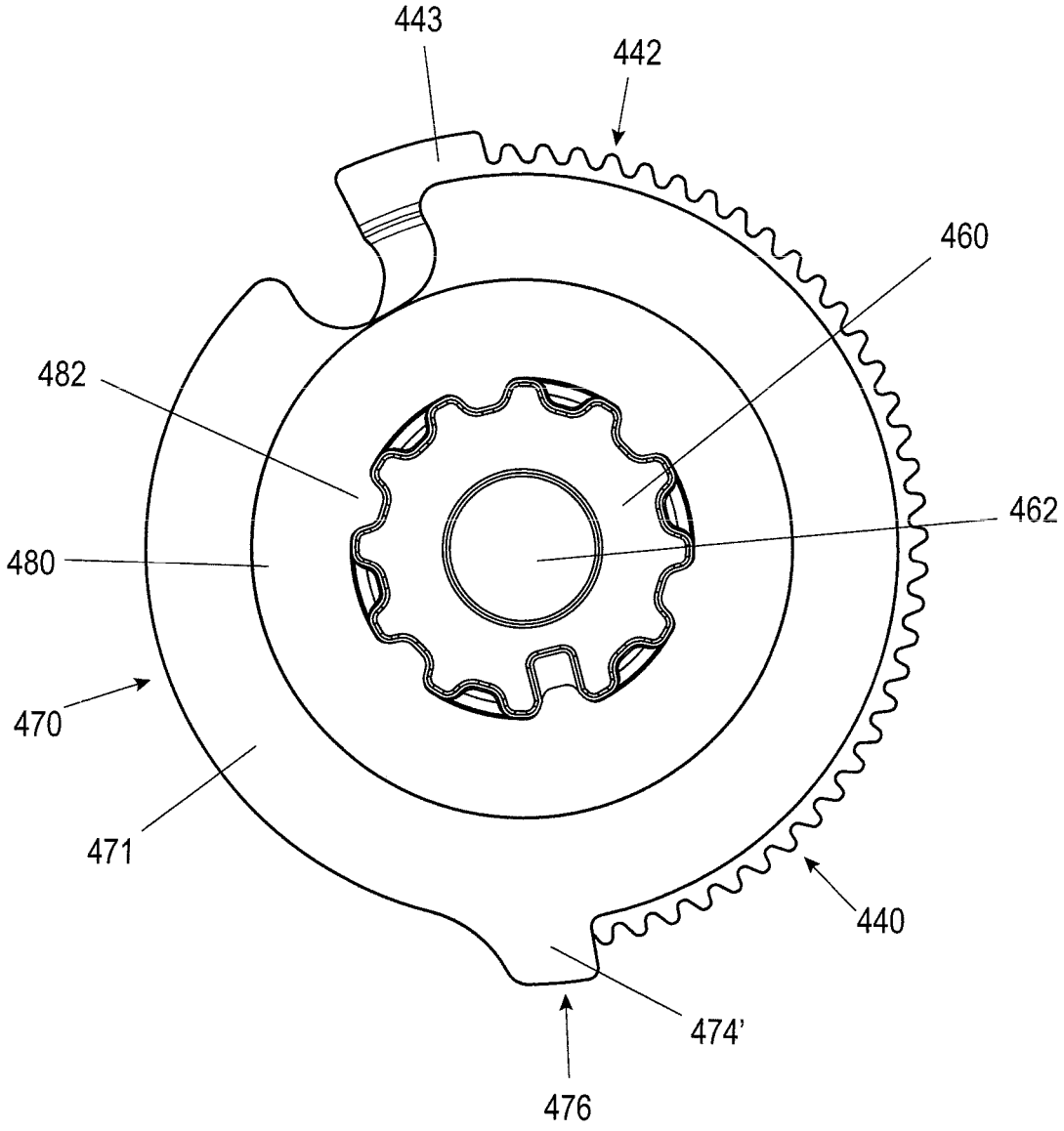
Figure 31:
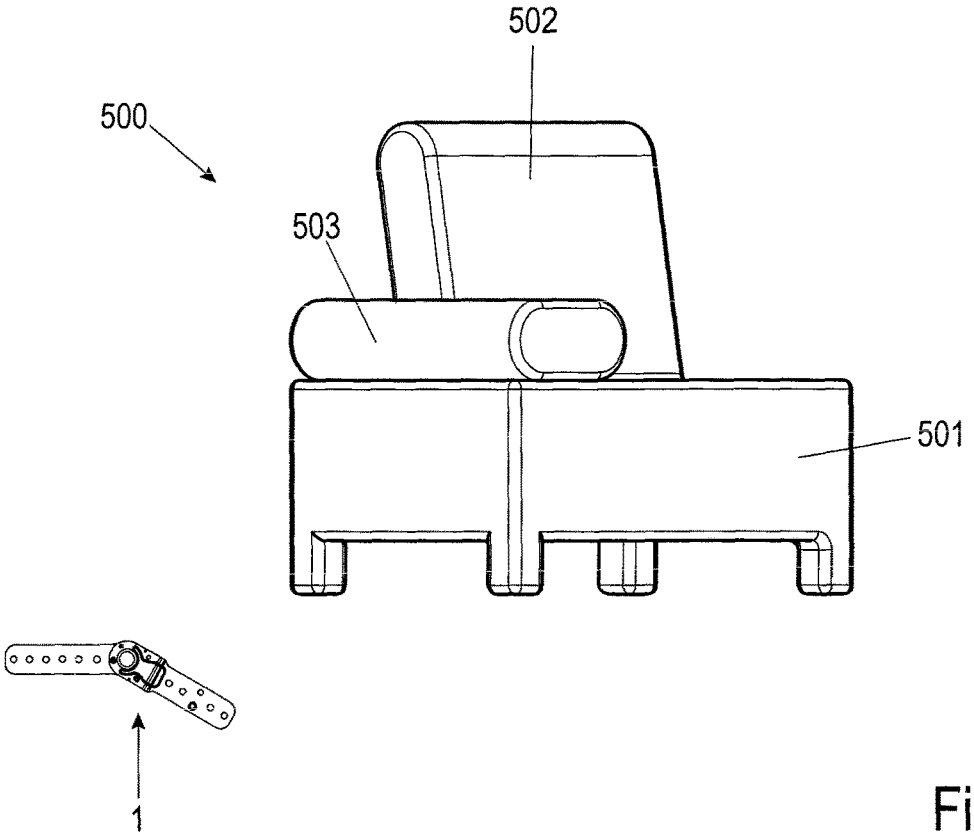
Figure 32:
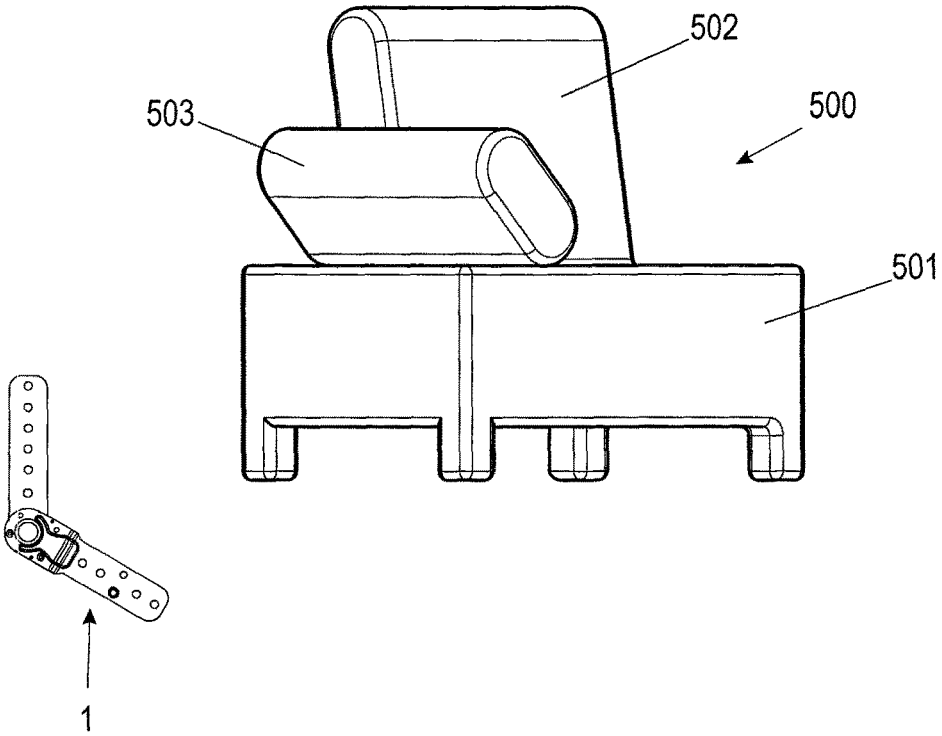
Figure 33:
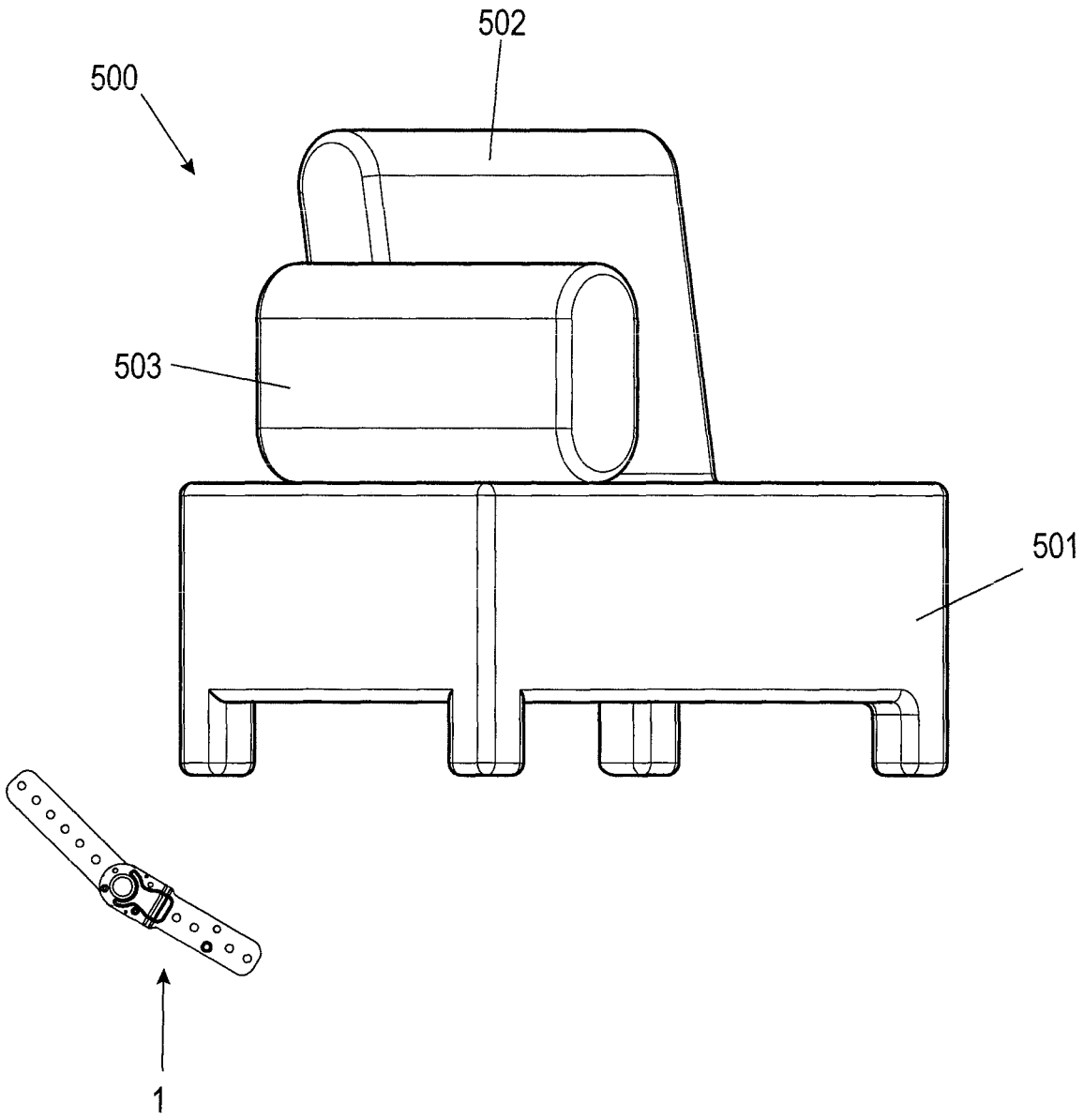

Exemplary embodiments of the invention are explained hereafter on the basis of the appended drawings. In the figures:

FIG. 1 shows a perspective exploded illustration of a first embodiment variant of a pivot fitting according to the invention, FIG. 2 shows a top view of the second lever according to FIG. 1 having toothing secured thereon, FIG. 3 shows a side view of the first lever according to FIG. 1 having pawls fastened thereon, FIG. 4 shows a top view of the control disk according to FIG. 1, FIG. 5 shows a schematic top view of the pivot fitting according to FIG. 1 with first cover omitted in a base position, FIG. 6 shows an illustration corresponding to FIG. 5 of the pivot fitting in a first catch position, FIG. 7 shows an enlarged view of a detail of the pivot fitting according to FIG. 5 with levers pivoted further in the adjustment direction having pawl disengaged from the toothing, FIG. 8 shows an illustration corresponding to FIG. 7 having alternative embodiment variant of the control disk, in which the pawl slides from one catch position into the next catch position upon adjustment of the levers in relation to one another in the adjustment direction, FIG. 9 shows a top view corresponding to FIG. 5 in a catch position, FIG. 10 shows a top view of the pivot fitting according to FIG. 5 in the switchover position, in which the two levers are pivoted in relation to one another out of the base position by the entire possible angle, FIG. 11 shows an illustration corresponding to FIG. 5 of the pivot fitting during a pivot in the reset direction, FIG. 12 shows an illustration of the pivot fitting corresponding to FIG. 5 in a position before switching over the movement direction of the levers in relation to one another in the adjustment direction, FIGS. 13 and 14 show illustrations corresponding to FIG. 5 of the pivot fitting during the movement in the adjustment direction or load direction to reach the catch position shown in FIG. 14, FIG. 15 shows a perspective exploded illustration of an alternative embodiment variant of a pivot fitting according to the invention having inner toothing provided on the second lever, FIGS. 16*a* and 16*b* show different views of a control disk used in the pivot fitting according to FIG. 15, FIG. 17 shows an illustration corresponding to FIG. 5 of a pivot fitting shown in FIG. 15 in the base position of the lever, FIG. 18 shows an illustration corresponding to FIG. 17 of the pivot fitting in the position of the levers maximally pivoted in relation to one another, FIG. 19 shows an illustration of the pivot fitting corresponding to FIG. 18 during the movement of the levers in relation to one another in the reset direction having pawl held disengaged by the lobes, FIGS. 20 and 21 show illustrations corresponding to FIGS. 13 and 14 of the pivot fitting when switching over the levers during the movement in the reset direction back in the adjustment direction, FIGS. 22 and 23 show further perspective exploded illustrations of further embodiment variants of pivot fittings according to the invention, FIG. 24 shows a perspective exploded illustration of a further embodiment variant of a pivot fitting according to the invention, FIG. 25 shows a perspective view of a further embodiment variant of a toothing integrally formed with a force shaft, FIG. 26 shows a perspective view of a further embodiment variant of a pawl, FIG. 27 shows a perspective view of the toothing according to FIG. 25 having control disk secured thereon, FIG. 28 shows a side view of the toothing according to FIG. 27, FIGS. 29 and 30 show top views of the toothing according to FIG. 27 having two control disks having differently formed switchover contours, and FIGS. 31 to 33 show perspective illustrations of a piece of upholstered furniture having armrest in different catch positions.

DETAILED DESCRIPTION

In the following description of the figures, terms such as upper, lower, left, right, front, rear, etc. relate exclusively to the exemplary illustration and position of the pivot fitting, the levers, the toothing, the pawl, the control disk, and the like selected in the respective figures. These terms are not to be understood as restrictive, i.e., these references can change due to different operating positions or mirror-symmetrical design or the like.

A piece of furniture, designed by way of example here as a piece of upholstered furniture, which is designed here as a piece of seating furniture, in particular as an armchair, is identified in FIGS. 31 to 33 with the reference sign 500, having a body 501, a backrest 502, and an armrest or headrest 503. The armrest or headrest 503 is fastened on the body 501 so it can be latched in different positions in this case. In this case, a pivot fitting provided here with the reference sign 1 is used for the adjustment, using which adjusting the armrest or headrest 503 out of the base position shown in FIG. 31 via the angled position shown in FIG. 32 into the upright position shown in FIG. 33 and latching it in these respective positions is enabled.

Using the pivot fitting 1, for which various embodiment variants of pivot fittings 100, 200, 300 are described hereafter, in addition, adjusting this armrest or headrest 503 out of the position shown in FIG. 33 back into the position shown in FIG. 32 is enabled, without firstly having to pivot the armrest or headrest 503 back into the base position shown in FIG. 31.

A first embodiment variant of a pivot fitting suitable for such an adjustment will be described hereafter on the basis of FIGS. 1 to 14.

Further exemplary embodiments are described on the basis of FIGS. 15 to 30.

All of the embodiment variants share the feature that a pivot fitting 1, 100, 200, 300, 400 comprises a first lever 2, 120, 220, 320, 420 and a second lever 3, 130, 230, 330, which are mounted so they are pivotable in relation to one another around a common axis D out of a base position by a predetermined angle α.

The pivot fitting 1, 100, 200, 300, 400 furthermore comprises a clamping mechanism, using which the two levers 2, 120, 220, 320, 420, 3, 130, 230, 330 are fixable in relation to one another in different angular positions within the predetermined angle α.

The clamping mechanism comprises a toothing 4, 140, 240, 340, 440 secured in a rotationally-fixed manner on the second lever 3, 130, 230, 330 and also at least one pawl 5, 150, 250, 350, 450, which is mounted so it is pivotable on the first lever 2, 120, 220, 320, 420 and is loaded in the direction of the toothing 4, 140, 240, 340, 440, and which is engaged with the toothing 4, 140, 240, 340, 440 in a catch position.

The clamping mechanism additionally comprises a control disk 7, 170, 270, 370, 470 mounted so it is rotatable around the common axis D, using which the at least one pawl 5, 150, 250, 350, 450, after running over the predetermined angle α from the base position in an adjustment direction V, can be disengaged from the toothing 4, 140, 240, 340, 440, so that if the pawl 5, 150, 250, 350 is disengaged from the toothing 4, 140, 240, 340, 440 by running over the predetermined angle α in a reset direction R, the two levers 2, 120, 220, 320, 420, 3, 130, 230, 330 are pivotable back into the base position.

The control disk 7, 170, 270, 370, 470 is drivable by bearing in a friction-locked manner on the toothing 4, 140, 240, 340, 440 in this case and is mounted so it is rotatable by a pivot angle β in relation to the first lever 2, 120, 220, 320, 420.

In the first embodiment variant illustrated in FIGS. 1 to 14, the first lever 2 consists of two substantially structurally-equivalent covers, namely a first cover 2*a* and a second cover 2*b*.

Each of these covers 2*a*, 2*b* comprises a lever arm 21, which merges via a bent region 22 into a lever head 23. A circular receptacle 25, which is used to guide through a force shaft 6 having polygonal lateral surface, is provided in the lever head 23.

Instead of the polygonal shape of the force shaft and the rotationally-fixed coupled components associated with it, of course, any arbitrary other shape effectuating a formfitting connection can be selected, for example, a tongue-and-groove connection. The toothing 4 and the control disk 7 are accommodated between the lever hoods 23 of the first cover 2*a* and the second cover 2*b*. The toothing 4 is formed in this embodiment variant in the form of two partially-circular toothed pulleys 4*a*, 4*b*.

Each of the toothed pulleys 4*a*, 4*b* has an outer toothing formed on a partially-circular outer edge. The toothed pulleys 4*a*, 4*b* are provided with a recess 44 having a polygonal cross section corresponding to the force shaft 6 to accommodate the force shaft 6.

The force shaft 6 extends in this case through the receptacles 25 of the first cover 2*a* and the second cover 2*b*, the toothed pulleys 4*a*, 4*b*, a spring element 10, and through a receptacle 33 of the second lever 3, which also has a polygonal cross section corresponding to the force shaft 6, so that the toothing 4 is coupled in a rotationally-fixed manner to the second lever 3.

The pawl 5 used for latching with the toothing 4 is, as can be seen in FIGS. 1 to 3, assembled in two parts from two pawl elements 5*a*, 5*b* in this embodiment variant, wherein each one of the pawl elements 5*a*, 5*b* is arranged in a plane with respectively one of the toothed pulleys 4*a*, 4*b*.

The pawl elements 5*a*, 5*b* are mounted in this case so they are pivotable on the first lever 2 via a pawl bolt 9. For this purpose, each of the pawl elements 5*a*, 5*b* has a bearing borehole 53, in which the pawl bolt 9 is accommodated. The pawl bolt 9 extends in this case between the two lever heads 23 of the first cover 2*a* and the second cover 2*b*.

The control disk 7 is accommodated between the two partially-circular toothed pulleys 4*a*, 4*b*. A top view of such an embodiment variant of a control disk 7 is shown in FIG. 4. The control disk 7 consists in this case essentially of a ring 71 having a central recess 72, through which the force shaft 6 extends in the installed state, but which is not coupled thereto in a rotationally-fixed manner.

The control disk 7 has an opening 73 on an outer circumference, in which a control bolt 8 extending on the first lever 2, here between the lever heads 23 of the first cover 2*a* and the second cover 2*b*, is accommodated. The opening 73 is dimensioned in this case in such a way that the control bolt 8 is displaceable by the switching angle β in relation to the control disk 7.

In the embodiment variant shown here, the width of the opening 73 in the circumferential direction is accordingly greater than the diameter of the control bolt 8. The width of this opening 73 is dimensioned in this case in such a way that the control disk 7 is displaceable by the switching angle β in relation to the control bolt 8 and the pawl bolt 9.

The first spring element 10, which is formed here as a disk spring, is used to apply the force necessary for the friction-locked bearing of the control disk 7 on the toothing 4, which spring element, as shown in FIGS. 1 and 2, bears on one hand, on the lever head 32 of the second lever 3 and, on the other hand, on the end face of a bearing ring 13, which presses with a neck part through the receptacle 25 of the second cover 2*b* of the first lever 2 against an end face of the second toothing part 4*b*.

The counter pressure is effectuated in this case by a neck part of the force shaft 6 extending through the receptacle 25 of the first cover 2*a*, which bears on the end face of the first toothing part 4*a*.

In order to always press the pawl 5, the two pawl parts 5*a* and 5*b* here, in the direction of the outer toothing 42 of the toothing 4, a second spring element 11 is provided, which is arranged between the lever heads 23 of the first cover 2*a* and the second cover 2*b* and circumferentially encloses the intermediate space. The two lower ends of this second spring element 11, which is formed here as a leaf spring and is also used to cover the intermediate space between the lever heads 23 of the first cover 2*a* and the second cover 2*b*, are bent over in this case in the direction of the pawl elements 5*a*, 5*b* and thus continuously press the pawl elements 5*a*, 5*b* in the direction of the outer toothing 42 of the two toothing parts 4*a*, 4*b*.

A central bolt 12, which extends through a central bore-hole of the force shaft 6 up into a counter disk 14 on the outer side of the lever head 32 of the second lever 3, is preferably used for axially fixing the components of the pivot fitting 1.

The function of the pivot fitting 1 will be described hereafter on the basis of FIGS. 5 to 14.

A base position of the pivot fitting 1 having exposed clamping mechanism is shown in FIG. 5 in this case.

In the movement sequence shown in FIGS. 5 to 14, the second lever 3 is fixed in place, while the first lever 2 is pivoted in relation to the second lever 3 in an adjustment direction V (counterclockwise in FIG. 5) for the adjustment to its base position shown in FIG. 5.

A movement of the first lever 2 in relation to the second lever 3 opposite to the adjustment direction V is referred to as the reset direction R.

As shown in FIG. 5, in the base position, the control disk 7 is positioned in such a way that a second support surface 76 of a switchover contour 74 of the control disk 7 rests on a second support surface 56 of the pawl 5, whereby the teeth 52 of the pawl 5 are disengaged from the toothing 4.

In this position, the control bolt 8 bears on a right lateral edge of the opening 73 of the control disk 7.

If the first lever 2 is now pivoted in the adjustment direction V in relation to the second lever 3, the control bolt 8 is thus moved in the recess 73 of the control disk 7 away from the right lateral edge in the direction of the left lateral edge.

At the same time, the pawl 5, which is fastened via the fixing bolt 9 so it is fixed in place but is pivotable on the first lever 2, is moved in the adjustment direction V. The switchover contour 74 thus slips down from the second support surface 56 of the pawl 5 and plunges into the recess 54 of the pawl 5.

In this case, the pawl 5 is pressed by means of the second spring element 11 into the outer toothing 42 of the toothing 4 in a first catch position. Reaching this first catch position is audible due to the striking of the pawl 5 on the toothing 4. This first catch position preferably occurs in this case upon a pivot of the first lever 2 in relation to the second lever 3 by 5°.

The control disk 7 is held during this first pivot movement in a friction-locked manner between the two toothing parts 4*a* and 4*b*. The friction-locked holding of the control disk 7 between the toothing parts 4*a*, 4*b* of the toothing 4 is effectuated in this case, as described above, by the first spring element 10, formed here as a disk spring.

The use of an O-ring or a screw acting on the toothing parts 4*a*, 4*b*, using which the amount of the friction would be settable, is also conceivable.

If the first lever 2 is moved further in the adjustment direction V, the control bolt 8 finally comes into contact on the left lateral edge of the recess 73 of the control disk 7.

From a predetermined adjustment angle γ, according to an embodiment variant shown in FIG. 7, a first support surface 75 of the switchover contour 74 of the control disk 7 is pushed onto a first support surface 55 of the pawl 5 on the left of the recess 54 and thus again disengages the teeth 52 of the pawl 5 from the outer toothing 42 of the toothing 4, so that upon a further pivot of the first lever 2 in the adjustment direction V, the pawl 5 is now held disengaged from the toothing 4 due to the now common movement with the control disk 7. The control disk 7 is moved along in this case with the control bolt 8 secured fixed in place on the first lever 2.

To assume a catch position, the second lever 2 is moved slightly, preferably by an angle of approximately 2°, in the reset direction R because of the preferred formation of the teeth of the toothing 4 and the teeth 52 of the pawl 5.

In this case, the switchover contour 74 slides the control disk 7 back into the recess 54 of the pawl 5 again, so that the teeth 52 of the pawl 5 latch with the outer toothing 42 of the toothing 4. Such an angular position of the pivot fitting 1 is illustrated by way of example in FIG. 9.

In the alternative embodiment variant shown in FIG. 8, the geometry of the switchover contour 74' of the control disk 7 is different from the switchover contour 74 (shown in FIG. 7), in such a way that the switchover contour 74' has a lesser angular width, so that the pawl 5 is moved from one catch position to the next upon further movement of the first lever 2 out of the position shown in FIG. 6 in the adjustment direction V.

The geometry of the teeth 52 of the pawl 5 and the outer toothing 42 of the toothing 4 is selected in this case so that a displacement in the adjustment direction is enabled and a displacement in the reset direction is obstructed.

A switchover position is illustrated in FIG. 10, in which the first lever 2 is pivoted by the maximum adjustment angle α in relation to the second lever 3. In this position, the teeth 52 of the pawl 5 are pushed onto a protrusion 43 of the toothing 4, so that the teeth 52 of the pawl 5 are lifted out of the engagement with the outer toothing 42 of the toothing 4.

During a subsequent pivot of the first lever 2 in relation to the second lever 3 in the reset direction R, the control disk 7, again because of the friction-locked holding between the toothing parts 4*a* and 4*b* of the toothing 4, remains fixed in place in its position until the control bolt 8 reaches the left edge of the opening 73 of the control disk 7 in FIG. 11.

During this pivot movement up into the position shown in FIG. 11, the second support surface 76 of the control disk 7 is again pushed onto the second support surface 56 of the pawl 5, so that the pawl 5 is still held disengaged from the toothing 4 and thus enables the pivoting of the first lever 2 in the reset direction R.

If, during the pivot of the first lever 2 in the reset direction R, the pivot fitting 1 is now latched again in such an intermediate position before reaching the base position, for example, in the position shown in FIG. 12, it is thus only necessary to move the first lever 2 slightly in the adjustment direction V.

Since the control bolt 8 moves inside the opening 73 of the control disk 7 during this pivot movement, the control disk 7 remains fixed in place at its location because of friction during this pivot movement.

The pawl 5 itself is pushed down by the pivot movement from the second support surface of the switchover contour 74 of the control disk 7, so that the teeth 52 of the pawl 5 latch with the outer toothing 42 of the toothing 4. This position is shown in FIG. 14.

The same movement sequence will be described hereafter for an alternative embodiment variant of a pivot fitting 100 according to the invention on the basis of FIGS. 15 to 21.

The pivot fitting 100 functions according to the same action principle. A control disk 170 is also pressed in a friction-locked manner against a toothing 140 here.

In contrast to the embodiment variant shown in FIGS. 1 to 14, the toothing 140 is formed here as an inner toothing integrated into the lever head 132 of the second lever 130.

In this embodiment variant, the second lever 130 is mounted between the first cover 120*a* and the second cover 120*b* of the first lever 120.

Instead of the force shaft 6, a central bolt 102 is used here to define the pivot axis D, which is accommodated in a bore 124 of the two covers 120*a*, 120*b* and in a receptacle 135 in the lever head 132 of the second lever 130.

The pivot fitting 100 comprises two pawls 150 here, which are spaced apart from one another and are arranged with point symmetry around the rotational axis D, and which are provided with outer toothing 152 corresponding to the inner toothing 140 on the second lever 130.

The pawls 150 are secured via respective fixing and control bolts 180, 190 in a rotationally-fixed manner on the first cover 120*a* and the second cover 120*b* in respective receptacles 125.

The contact pressure of the pawls 150 on the toothing 140 formed as an inner toothing is performed by a second spring element 101, which is preferably formed as a leaf spring bent in a U-shape or V-shape, using which the teeth 152 of the pawl 150 are pressed into the inner toothing of the toothing 140.

The control disk 170 has in this case, as is apparent in FIG. 16, a ring disk 171 having a central bearing opening 172, through which the central bolt 102 extends.

Furthermore, oblong holes 173 are provided in the ring disk 172, through which the fixing and control bolts 180, 190 extend. The length of these oblong holes 173 is embodied in this case corresponding to the angular width of the opening 73 of the control disk 7 of the first exemplary embodiment, to enable a pivot movement of the first lever 120 in relation to the second lever 130 by a predetermined angle, without the control disk 170 also being rotated.

The preferably four switchover contours 174 of the control disk 170 are formed in this embodiment variant as lobes stamped out of a ring disk 171 and bent toward the pawl 150, as shown by way of example in FIGS. 16*a* and 16*b*.

For improved alignment of the control disk 170 in a plane parallel to the planes of the lever heads 123 of the first cover 120*a* and the second cover 120*b*, the bearing opening 172 is bordered by a cylindrical neck part 175.

The first spring element 110 is, as shown in FIG. 15, formed as a ring spring plate, which is fixed in a fixed location on the second lever 130 via pins 133.

The contact pressure force acting axially toward the toothing 140 is effectuated by support tongues 111, which are formed on the first spring element 110 and aligned radially inward, and which ensure the required friction lock between the control disk 170 and the toothing 140.

Oblong holes 134, which are used to accommodate the fixing and control bolts 180, 190, are provided in the lever head 133 of the second lever 130. The length of these oblong holes 134 is dimensioned in this case in such a way that the two levers 120, 130 are pivotable in relation to one another by the predetermined angle $\alpha$.

FIG. 17 shows the base positions of the two levers 120, 130 in relation to one another. In this base position, the two pawls 150 are disengaged from the inner toothing of the toothing 140.

For this purpose, the switchover contours 174, which are formed as lobes, rest on a second support surface 156 of the pawls, as shown in FIG. 17.

Upon pivoting of the first lever 120 in relation to the second lever 130, the pawls 150 are accordingly moved away from the switchover contours 174 (clockwise in FIG. 17), so that the teeth 152 of the pawls 150 engage in the inner toothing of the toothing 140.

FIG. 18 shows the switchover position of the levers 120, 130 in relation to one another pivoted by the maximum angle $\alpha$. In this position, a part of the teeth 152 of the pawls 150 is pushed onto a protrusion 141 of the toothing 140.

This protrusion 141 is formed on the toothing 140 in the exemplary embodiment shown.

However, it is also conceivable to form the protrusion 141 as an installable insert, which is placed on a corresponding position of the toothing 140.

As can furthermore be seen in FIG. 18, the fixing and control bolts 180, 190 bear on the front edge, in the adjustment direction V, of the oblong holes 173 of the control disk 170 in this switchover position.

If the first lever 120 is moved in relation to the second lever 130 during the subsequent pivot in the reset direction R, the pawls 150 are again pushed onto the switchover contour 174 of the control disk 170, which is stationary at the beginning of the pivot movement, so that, as shown in FIG. 19, a second support surface 156 of the pawls 150 rests on the switchover contours 174 formed as lobes.

During the subsequent further movement of the first lever 120 in relation to the second lever 130 in the reset direction, the pawls 150 are moved together with the control disk 170, which is carried along by the fixing and control bolt 180, 190, while resting on the switchover contours 174, in the reset direction, without catching in the teeth of the toothing 140.

If a catch position is again to be assumed during the pivot of the levers 120, 130 in relation to one another in the reset direction, the first lever 120 first has to be moved somewhat in the adjustment direction V in relation to the second lever 130, as shown in FIG. 20.

In this case, the pawls 150 are moved away from the respective switchover contour 174, so that the teeth 152 of the pawls 150 strike on the toothing 140, so that the catch position shown in FIG. 21 is reached by a subsequent slight pivot of the first lever 120 in relation to the second lever 130 in the reset direction R.

FIGS. 22 and 23 show exploded illustrations of further embodiment variants of a pivot fitting 200, 300 according to the invention.

The pivot fittings 200, 300 essentially correspond in this case to the pivot fitting 100 described on the basis of FIGS. 15 to 21.

Accordingly, the reference signs assigned in FIGS. 22 and 23 are assigned in accordance with the embodiment variant shown in FIG. 15.

In contrast to the pivot fitting 100 described on the basis of FIGS. 15 to 21, in the pivot fitting 200 shown in FIG. 22, the toothing 240 is formed on a separate ring body 241.

The toothing 243 is also formed here as inner toothing, in which the teeth 252 of pawls 250 engage.

The ring body 241 of the toothing 240 comprises, similarly to the pivot fitting 1 shown in FIG. 1, a polygonal receptacle 242, in which a force shaft 260 engages.

The force shaft 260 also engages in this case in the second lever 230, in a correspondingly shaped receptacle 233 having polygonal cross section therein, so that the second lever 230 is coupled in a rotationally-fixed manner to the toothing 240.

The first spring element 210 and the control disk 270 are formed in accordance with the embodiment variant of the pivot fitting 100 described in FIGS. 15 to 21.

In the embodiment variant of a pivot fitting 300 according to the invention shown in FIG. 23, the toothing 340 is again formed directly on the second lever 330 similarly to the embodiment variant of the pivot fitting 100 described in FIGS. 15 to 21.

In this embodiment variant, the first lever 320 is formed so that a lever head 322, which comprises a receptacle 323 having polygonal cross section, extends linearly formed from a lever arm 321.

The covers of the first lever 320 enclosing the clamping mechanism are formed here as separate components 324, 325, so that accordingly the first cover 324 and the second cover 325 comprise corresponding central recesses 327 having polygonal cross section, so that the covers 324, 325 are coupled in a rotationally-fixed manner to the first lever 320.

FIG. 24 shows an exploded illustration of a further embodiment variant of a pivot fitting 400 according to the invention without illustration of the second lever, which preferably corresponds to the lever 3 described in the first exemplary embodiment shown in FIGS. 1 to 14.

The pivot fitting 400 corresponds in this case in essential parts to the pivot fitting 1 described on the basis of FIGS. 1 to 14.

Accordingly, the reference signs assigned in FIGS. 24 to 30 are assigned in accordance with the first embodiment variant shown in FIG. 1.

In contrast to the pivot fitting 1, in the pivot fitting 400 shown in FIG. 24, only one toothing 440 is formed on a ring body 441.

The toothing 440 is integrally formed here with the force shaft 460, in particular as a sintered part. The force shaft 460 is formed here for the rotationally-fixed connection to the second lever (not shown here) using, for example, a polygonal outer contour 461. The force shaft 460 furthermore comprises a receptacle 462, in which the central bolt 12 is accommodated.

The second lever is also coupled in a rotationally-fixed manner to the toothing 440 by this structure.

The control disk 470 is formed in this embodiment variant, as shown in FIG. 28, as a disk spring or spring plate, which is arranged laterally on the ring body 441 of the toothing 440.

A ring disk 480 pushed onto a part of the force shaft 460 presses the control disk 470 with pre-tension against the ring body 441 of the toothing 440. To fasten this ring disk 480 on the part of the force shaft 460, the ring disk 480 is pressed, for example, like a shaft retainer with a press fit onto the outer contour 461 of the force shaft 460. It is also conceivable to weld the ring disk 480 onto the force shaft 460. It is conceivable to provide an undercut on the outer contour 461 of the force shaft 460, which can be pressed onto the ring disk 480. In addition, it is also conceivable to hold down the ring disk 480 using a lock ring or also to replace it with such a lock ring.

It is moreover conceivable to press the ring disk 480 against the control disk 470 by suitable selected spacing between the lever heads 423 of the first cover 420*a* and the second cover 420*b* during assembly, for example, by suitable spacers.

The ring disk 480 has tongues 482 extending radially inward from a ring-shaped base body 481 for the rotation lock in relation to the force shaft 480, as shown in FIG. 27.

As shown in FIG. 24, in this embodiment variant, the pivot fitting 400 accordingly also comprises only one pawl 450. This pawl 450, as shown in FIG. 26, is integrally formed with a pawl bolt 490, preferably as a sintered part, in contrast to the first embodiment variant, and is mounted via this so it is pivotable on the first lever 420. The installation is thus simplified because of the reduced number of components.

In the top views shown in FIGS. 29 and 30, two control disks 470 having differently formed switchover contours 474, 474' are arranged on the toothing 440 for direct comparison.

The switchover contour 474 shown in FIG. 29 corresponds to the variant described on the basis of the first exemplary embodiment, wherein the switchover contour 474 is formed in such a way that the pawl 450 is held disengaged from the toothing, supported on a first support surface 475 of the switchover contour 474, during adjustment of the levers in relation to one another in the adjustment direction from a predetermined adjustment angle, which enables a silent adjustment as described above during adjustment of the levers in relation to one another in the adjustment direction, since the pawl 450 does not engage with the toothing 440 due to the support on the switchover contour 474.

In the switchover contour 474' shown in FIG. 30, this first support surface 475 is absent, so that the pawl 450 is guided touching the toothing 440 during adjustment of the levers 420, 3 in relation to one another in the adjustment direction.

This variant of the switchover contour enables an audible catching of the pawl during the adjustment in the adjustment direction.

In the mentioned exemplary embodiments of the invention for adjusting backrests, armrests, footrests, or headrests on items of furniture, in general a horizontally aligned pivot axis D of the movable furniture part is provided in relation to the furniture body.

It is to be noted that other applications, in which the pivot axis is aligned vertically or diagonally in space, are also possible. For example, a backrest of a piece of seating furniture can also be pivotable around a vertical pivot axis D, so that one does not adjust the backrest inclination, but rather the angular position of the backrest in space.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 pivot fitting
2 first lever
2*a* first cover
2*b* second cover
21 lever arm
22 bending range
23 lever head
24 borehole
25 receptacle
26 borehole
27 recess
28 reinforcement
3 second lever
31 lever arm
32 lever head
33 receptacle
4 toothing
4*a* first toothing part/toothed pulley
4*b* second toothing part/toothed pulley
41 toothed ring part
42 outer toothing
43 protrusion
44 recess
5 pawl
5*a* first pawl part
5*b* second pawl part
51 pawl arm
52 teeth
53 bearing borehole
54 recess
55 first support surface
56 second support surface
6 force shaft
7 control disk
71 ring
72 recess
73 opening
74 switchover contour
74' switchover contour
75 first support surface
76 second support surface
8 control bolt
9 pawl bolt
10 first spring element
11 second spring element
12 central bolt
13 bearing ring
14 counter disk
100 pivot fitting
101 second spring element
102 central bolt
110 first spring element
111 support tongue
120 first lever
120*a* first cover
120*b* second cover
121 lever arm
122 bending range
123 lever head
124 borehole
125 receptacle
130 second lever
131 lever arm
132 lever head
133 pin
134 oblong hole
135 receptacle
140 toothing
141 protrusion
150 pawl
151 pawl arm
152 teeth
153 bearing borehole
154
155 first support surface
156 second support surface
170 control disk
171 ring disk
172 bearing opening
173 oblong hole
174 switchover contour
175 neck part
176 recess
180 fixing and control bolt
190 fixing and control bolt
200 pivot fitting
201 second spring element
210 first spring element
211 support tongue
220 first lever
220*a* first cover
220*b* second cover
221 lever arm
222 bending range
223 lever head
224 borehole
225 receptacle
230 second lever
231 lever arm
232 lever head
233 receptacle
240 toothing
241 ring body

242 receptacle
243 inner toothing
244 oblong hole
245 pin
250 pawl
251 pawl arm
252 teeth
253 bearing borehole
260 force shaft
270 control disk
271 ring disk
272 bearing opening
273 oblong hole
274 switchover contour
275 neck part
276 recess
280 fixing and control bolt
290 fixing and control bolt
300 pivot fitting
301 second spring element
310 first spring element
311 support tongue
320 first lever
321 lever arm
322 lever head
323 receptacle
324 first cover
325 second cover
326 receptacle
327 receptacle
330 second lever
331 lever arm
332 lever head
333 receptacle
334 oblong hole
335 pin
340 toothing
350 pawl
351 pawl arm
352 teeth
353 bearing borehole
360 force shaft
370 control disk
371 ring disk
372 bearing opening
373 oblong hole
374 switchover contour
375 neck part
376 recess
380 fixing and control bolt
390 fixing and control bolt
400 pivot fitting
420 first lever
420*a* first cover
420*b* second cover
421 lever arm
422 bending range
423 lever head
424 borehole
425 receptacle
426 borehole
427 recess
440 toothing
441 toothed ring body
442 outer toothing
443 protrusion
450 pawl
451 pawl arm
452 teeth
454 recess
455 first support surface
456 second support surface
460 force shaft
461 outer contour
462 receptacle
470 control disk
471 ring
472 recess
473 opening
474 switchover contour
474' switchover contour
475 first support surface
476 second support surface
480 ring disk
481 ring disk body
482 outer contour
500 piece of furniture
501 body
502 back rest
503 arm rest
D axis
V adjustment direction
R reset direction
$\alpha$ maximum adjustment angle
$\beta$ switching angle
$\gamma$ predetermined adjustment angle

The invention claimed is:

1. A pivot fitting for movable furniture parts on pieces of furniture, the pivot fitting comprising:

a first lever and a second lever mounted so the first and second levers are pivotable in relation to one another around a common axis out of a base position by a predetermined angle;

a clamping mechanism, which fixes the two levers in relation to one another in different angle positions within the predetermined angle, wherein the clamping mechanism comprises a toothing secured in a rotationally-fixed manner on the second lever, at least one pawl, which is mounted so it is pivotable on the first lever and is loaded in a direction of the toothing, and which is engaged with the toothing in a catch position, a control disk mounted so it is rotatable around the common axis, wherein the control disk is configured to disengage the at least one pawl from the toothing after running over the predetermined angle from the base position in an adjustment direction, so that when the pawl is disengaged from the toothing by running over the predetermined angle in a reset direction, the two levers are pivotable back into the base position, wherein the control disk is carried along on the toothing while bearing thereon indirectly or directly in a friction-locked manner and is mounted so that the control disk is rotatable by a switching angle in relation to the first lever.

2. The pivot fitting of claim 1, wherein the control disk is a disk spring or a spring plate.

3. The pivot fitting of claim 1, wherein the clamping mechanism comprises a first spring element, which presses the control disk onto the toothing in a friction-locked manner.

4. The pivot fitting of claim 3, wherein the first spring element is a disk spring or spring plate.

5. The pivot fitting of claim 1, wherein the clamping mechanism comprises a second spring element, which presses the pawl against the toothing.

6. The pivot fitting of claim 5, wherein the first lever comprises a first cover and a second cover, wherein the toothing and the control disk are accommodated between lever heads of the covers, wherein the second spring element is arranged between the lever heads, circumferentially enclosing the toothing and the control disk.

7. The pivot fitting of claim 6, wherein the toothing is a circular inner toothing formed on a lever head of the second lever.

8. The pivot fitting of claim 6, wherein the toothing is a circular toothed pulley having inner toothing formed thereon, which is accommodated between the lever heads of the second lever.

9. The pivot fitting of claim 1, wherein the toothing is at least one toothed pulley, which is at least partially circular and which has outer toothing formed on a partially-circular outer edge, which is coupled via a force shaft to the second lever, and the pawl comprises a pivot arm having teeth facing toward the rotational axis of the first and second levers.

10. The pivot fitting of claim 9, wherein the toothing is integrally formed with the force shaft as a sintered part, wherein the control disk is arranged laterally on the toothing.

11. The pivot fitting of claim 9, wherein the toothing comprises two partially-circular toothed pulleys, wherein the control disk is arranged between the toothed pulleys.

12. The pivot fitting of claim 11, wherein the pawl comprises two pawl elements, wherein each one of the pawl elements is arranged in a plane with respectively one of the toothed pulleys.

13. The pivot fitting of claim 9, wherein the control disk comprises a switchover contour on an outer circumference, wherein the switchover contour pivots the pawl out of a catch position with the toothing into a non-catch position.

14. The pivot fitting of claim 13, wherein the pawl, adjacent to the teeth forming inner toothing, comprises a recess, into which the switchover contour is inserted in the catch position of the pawl with the toothing.

15. The pivot fitting of claim 13, wherein the switchover contour is formed in such a way that the pawl, upon adjustment of the levers in relation to one another in the adjustment direction from a predetermined adjustment angle, is held disengaged from the toothing while supported on a first support surface of the switchover contour.

16. The pivot fitting of claim 1, wherein the toothing is a circular inner toothing arranged on the second lever, and the at least one pawl comprises a pivot arm having teeth facing away from the rotational axis of the levers.

17. A piece of furniture, comprising:

a first furniture part;

a second furniture part; and a pivot fitting coupled to the first and second furniture parts, the pivot fitting comprising a first lever and a second lever mounted so the first and second levers are pivotable in relation to one another around a common axis out of a base position by a predetermined angle;

a clamping mechanism, which fixes the two levers in relation to one another in different angle positions within the predetermined angle, wherein the clamping mechanism comprises a toothing secured in a rotationally-fixed manner on the second lever, at least one pawl, which is mounted so it is pivotable on the first lever and is loaded in a direction of the toothing, and which is engaged with the toothing in a catch position, a control disk mounted so it is rotatable around the common axis, wherein the control disk is configured to disengage the at least one pawl from the toothing after running over the predetermined angle from the base position in an adjustment direction, so that when the pawl is disengaged from the toothing by running over the predetermined angle in a reset direction, the two levers are pivotable back into the base position, wherein the control disk is carried along on the toothing while bearing thereon indirectly or directly in a friction-locked manner and is mounted so that the control disk is rotatable by a switching angle in relation to the first lever.

18. The piece of furniture of claim 17, wherein the first furniture part is furniture body and the second furniture part is an armrest or other adjustable furniture part, and wherein the pivot fitting adjustably fixes the second furniture part.

* * * * *